US006397934B2

(12) United States Patent
Osakabe et al.

(10) Patent No.: US 6,397,934 B2
(45) Date of Patent: Jun. 4, 2002

(54) COOLING DEVICE BOILING AND CONDENSING REFRIGERANT

(75) Inventors: Hiroyuki Osakabe, Chita-gun; Yoshiyuki Okamoto, Nagoya; Kiyoshi Kawaguchi, Toyota, all of (JP)

(73) Assignee: Denso Corporation, Kariya (JP)

( * ) Notice: Subject to any disclaimer, the term of this patent is extended or adjusted under 35 U.S.C. 154(b) by 28 days.

(21) Appl. No.: 09/726,151

(22) Filed: Nov. 29, 2000

Related U.S. Application Data

(62) Division of application No. 09/193,141, filed on Nov. 17, 1998.

(30) Foreign Application Priority Data

| | | |
|---|---|---|
| Dec. 11, 1997 | (JP) | 09-340961 |
| Dec. 11, 1997 | (JP) | 09-341135 |
| Dec. 11, 1997 | (JP) | 09-341159 |
| Jan. 29, 1998 | (JP) | 10-16706 |
| Mar. 3, 1998 | (JP) | 10-50764 |

(51) Int. Cl.[7] ..... F28D 15/00

(52) U.S. Cl. ..... 165/104.21; 165/104.33; 257/715; 361/700

(58) Field of Search ..... 165/104.14, 104.22, 165/104.33, 80.4; 62/119, 121, 259.2; 361/700; 257/715

(56) References Cited

U.S. PATENT DOCUMENTS

| | | | | |
|---|---|---|---|---|
| 1,662,236 A | | 3/1928 | Coupland | |
| 3,552,487 A | | 1/1971 | Tokumitsu et al. | |
| 3,706,534 A | | 12/1972 | Verheul et al. | |
| 3,802,496 A | | 4/1974 | Ris et al. | |
| 3,807,494 A | | 4/1974 | Ris | |
| 4,524,823 A | | 6/1985 | Hummel et al. | |
| 4,616,697 A | * | 10/1986 | Kotaka | 165/104.14 |
| 4,745,965 A | * | 5/1988 | Katsura et al. | 165/104.14 |
| 4,982,782 A | * | 1/1991 | Albers et al. | 62/121 |
| 5,035,281 A | | 7/1991 | Neuenfeldt et al. | |

(List continued on next page.)

FOREIGN PATENT DOCUMENTS

| | | |
|---|---|---|
| DE | 1000194 | 1/1957 |
| DE | 1044125 | 11/1958 |
| GB | 2213920 A | 8/1989 |
| JP | A-56-119492 | 9/1981 |
| JP | A-59-29986 | 2/1984 |
| JP | A-2-61206 | 3/1990 |
| JP | A-10-2686 | 1/1998 |
| RU | 840672 | 6/1981 |
| RU | 1816949 | 5/1993 |

*Primary Examiner*—Henry Bennett
*Assistant Examiner*—Terrell McKinnon
(74) *Attorney, Agent, or Firm*—Harness, Dickey & Pierce, PLC

(57) ABSTRACT

A cooling device includes a boiling unit and a condensing unit. A diffusion plate having a plurality of holes is formed into a thin-long shape, and is disposed in an upper tank of the condensing unit at an approximate center in an up-down direction so that an inner space of the upper tank of the condensing unit is divided into upper and lower parts in the up-down direction. Each hole opened in the diffusion plate has an opening area smaller than a sectional surface area of an introduction port of a gas-refrigerant introduction pipe, opened in the upper tank of the condensing unit. Thus, gas refrigerant flowing into the upper tank of the condensing unit through the gas-refrigerant introduction pipe is diffused to all the upper part of the upper tank along the surface of the diffusion plate while passing through the holes of the diffusion plate downwardly. As a result, an entire area of the condensing unit can be effectively used, and heat-radiating performance of refrigerant in the condensing unit can be improved.

7 Claims, 25 Drawing Sheets

U.S. PATENT DOCUMENTS 5,241,839 A 9/1993 Hughes
5,242,016 A 9/1993 Voss et al.
5,415,223 A 5/1995 Reavis et al.
5,531,266 A 7/1996 Ragi et al.
5,632,329 A 5/1997 Fay
5,806,583 A * 9/1998 Suzuki et al. ..... 165/104.33
5,845,702 A * 12/1998 Dinh ..... 165/104.21
5,934,367 A 8/1999 Shimmura et al.
6,039,111 A * 3/2000 Kawaguchi et al. ... 165/104.14
6,119,767 A * 9/2000 Kadota et al. ..... 361/700

* cited by examiner

COOLING DEVICE BOILING AND CONDENSING REFRIGERANT

This is a division of U.S. patent application Ser. No. 09/193,141, filed Nov. 17, 1998.

CROSS-REFERENCE TO RELATED APPLICATION

This application is related to and claims priority from Japanese Patent Applications No. Hei. 9-340961 filed on Dec. 11, 1997, No. Hei. 9-341135 filed on Dec. 11, 1997, No. Hei. 9-341159 filed on Dec. 11, 1997, No. Hei. 10-16706 filed on Jan. 29, 1998, and No. Hei 10-50764 filed on Mar. 3, 1998, the contents of which are hereby incorporated by reference.

BACKGROUND OF THE INVENTION

1. Field of the Invention:

The present invention relates to a cooling device having a boiling unit in which refrigerant is boiled and evaporated, and a condensing unit in which refrigerant is condensed and liquefied.

2. Description of Related Art:

In a conventional heat exchanger described in JP-A-56-119492, a boiling unit and a condensing unit are connected circularly using two connection pipes. Therefore, refrigerant boiled in the boiling unit flows into the condensing unit through one connection pipe, is liquefied in the condensing unit, and is returned to the boiling unit through the other connection pipe. However, as shown in FIG. 31, gas refrigerant is ununiformly distributed in the condensing unit. That is, gas refrigerant mainly flows into a refrigerant passage "a" proximate to an gas-refrigerant inlet side, and hardly flows into a refrigerant passage "b" far from the gas-refrigerant inlet side. Thus, all the condensing unit cannot be effectively used, and heat-radiating performance of refrigerant in the condensing unit is decreased. Further, when the connection pipes are made longer or are bent, pressure loss in the refrigerant passage becomes larger, and a surface of liquid refrigerant rises in the condensing unit. Therefore, condensed liquid refrigerant stays in a refrigerant passage "c" where gas refrigerant hardly flows. Thus, the heat-radiating performance of refrigerant is further decreased in the condensing unit.

On the other hand, when a part of condensed liquid refrigerant is evaporated or a part of gas refrigerant is condensed in the connection pipes of the cooling device, convection flow of refrigerant is generated in the connection pipes, and the circulation of refrigerant in the cooling device is impeded. Therefore, the arrangement of the connection pipes is restricted.

SUMMARY OF THE INVENTION

In view of the foregoing problems, it is a first object of the present invention to provide a cooling device having first and second heat exchangers, in which gas refrigerant flowing into the second heat exchanger is diffused so that heat-radiating performance of gas refrigerant is improved in the second heat exchanger.

It is a second object of the present invention to provide a cooling device in which a connection pipe for connecting first and second heat exchangers can be freely arranged while circulation performance of refrigerant is improved.

It is a third object of the present invention to provide a cooling device in which a connection pipe for connecting first and second heat exchangers is formed to prevent gas refrigerant from being liquefied or liquid refrigerant from being evaporated in the connection pipe.

It is a fourth object of the present invention to provide a cooling device in which reserve refrigerant is stored in a connection pipe for connecting first and second heat exchangers so that cooling performance is maintained even when refrigerant leaks from the cooling device.

It is a sixth object of the present invention to provide a cooling device in which both first and second heat exchangers are connected using a short and straight connection pipe.

According to a first aspect of the present invention, in a cooling device including a first heat exchanger in which refrigerant is boiled and a second heat exchanger in which refrigerant condensed, there is provided with a diffusion unit which diffuses gas refrigerant flowing into an upper tank of the second heat exchanger to all the upper tank. Therefore. it can prevent gas refrigerant from mainly flowing into an inlet side in the upper tank of the second heat exchanger, and gas refrigerant can uniformly flows in the second heat exchanger. Thus, an entire area of the second heat exchanger can be effectively used for condensing gas refrigerant, and heat-radiating performance of refrigerant in the second heat exchanger can be improved.

Preferably, the diffusion unit is a diffusion plate having a plurality of openings each of which has opening area smaller than a passage sectional area of a first connection pipe through which gas refrigerant from the first heat exchanger is introduced into the upper tank of the second heat exchanger. Therefore, an inner space of the upper tank of the second heat exchanger can be divided into upper and lower spaces. Thus, gas refrigerant introduced into the upper tank of the second heat exchanger is diffused in all the upper tank while passing through the openings of the diffusion plate. As a result, the heat-radiating performance of refrigerant in the second heat exchanger can be further improved.

Further, the first connection pipe has a plurality of branched pipes connected to the upper tank of the second heat exchanger so that gas refrigerant is introduced into the upper tank of the second heat exchanger from the branched pipes. Therefore, gas refrigerant can be uniformly introduced into the upper tank of the second heat exchanger through the branched pipes, and can be readily diffused in the upper tank.

Preferably, at least one of the first connection pipe and a second connection pipe through which liquid refrigerant is introduced from a lower tank of the second heat exchanger to the first heat exchanger is formed into a multi-pipe structure in which a plurality of pipes having different diameters are assembled approximately concentrically. In the plurality of concentric pipes of the connection pipe, heat outside the most outer pipe is hardly transmitted into refrigerant flowing through an inner pipe. Thus, it can prevent gas refrigerant from being condensed or liquid refrigerant from being evaporated in the connection pipe having the multi-pipe structure, and circulation performance of refrigerant can be improved. As a result, the connection pipe can be readily arranged in the cooling device.

More preferably, the connection pipe has a predetermined pipe length so that a predetermined reserve refrigerant is stored, the second connection pipe has a lateral pipe portion extending approximately horizontally, and the lateral pipe portion is disposed between the first heat exchanger and the second heat exchanger. Therefore, cooling performance of the cooling device is maintained in a long time even when refrigerant leaks from the cooling device while a size of the cooling device is decreased.

According to a second aspect of the present invention, a cooling device includes a first heat exchanger in which liquid refrigerant is boiled and evaporated, and a second heat exchanger in which gas refrigerant is condensed and liquefied. In the cooling device, a part of tubes of the first and second heat exchangers is used as a refrigerant passage for circulating refrigerant between the first and second heat exchangers. Therefore, both the first and second heat exchangers can be connected using a short and straight connection pipe. Thus, strength of the connection pipe is improved, and assembling performance of the connection pipe to the first and second heat exchangers can be improved. Further, because the connection pipe is made shortly and straightly, the connection pipe can be produced in low cost.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention are described hereinafter with reference to the accompanying drawings.

Figure 1:
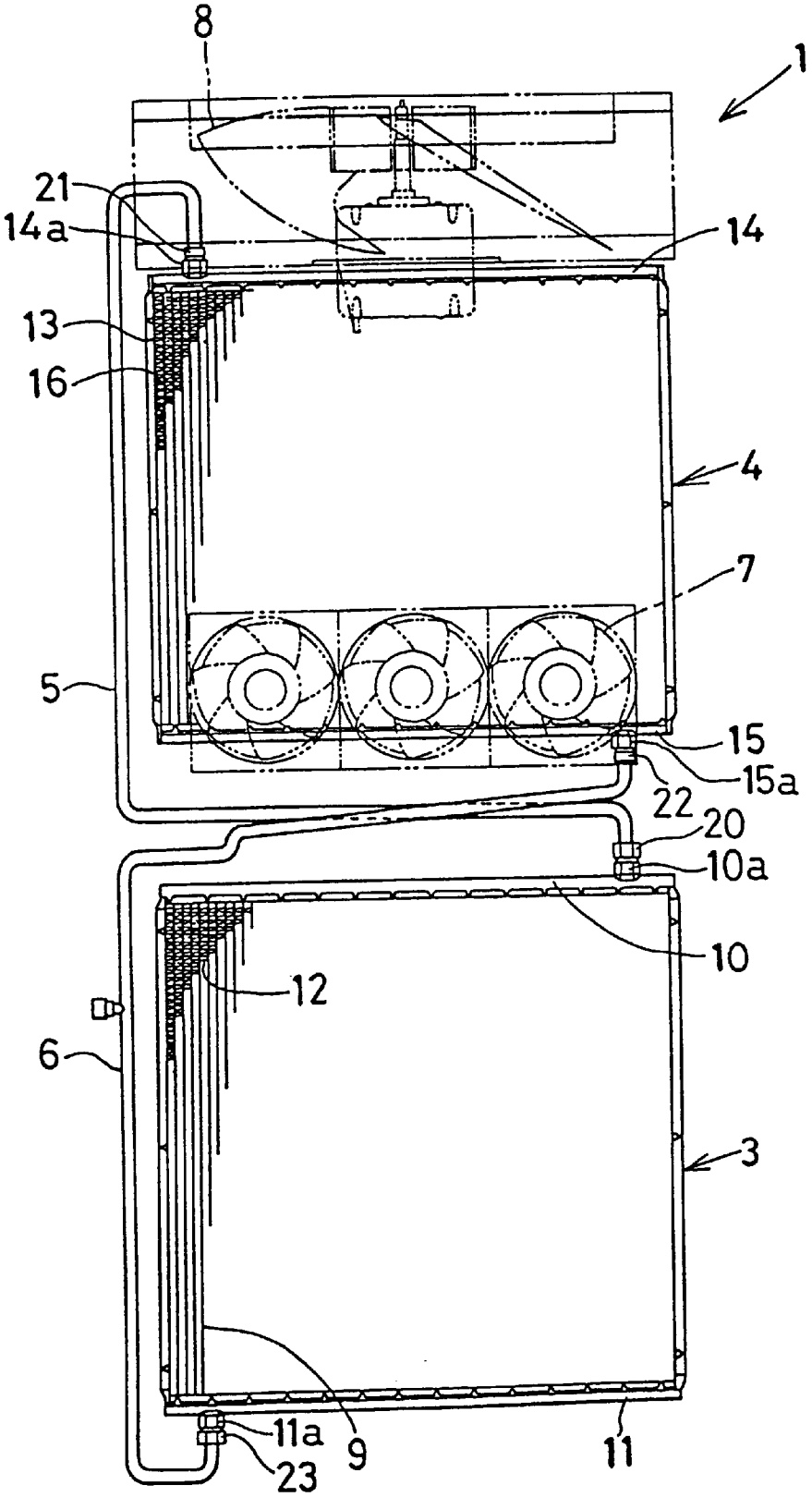
FIG. 1 is a front view showing a cooling device according to a first preferred embodiment of the present invention.
Figure 2:
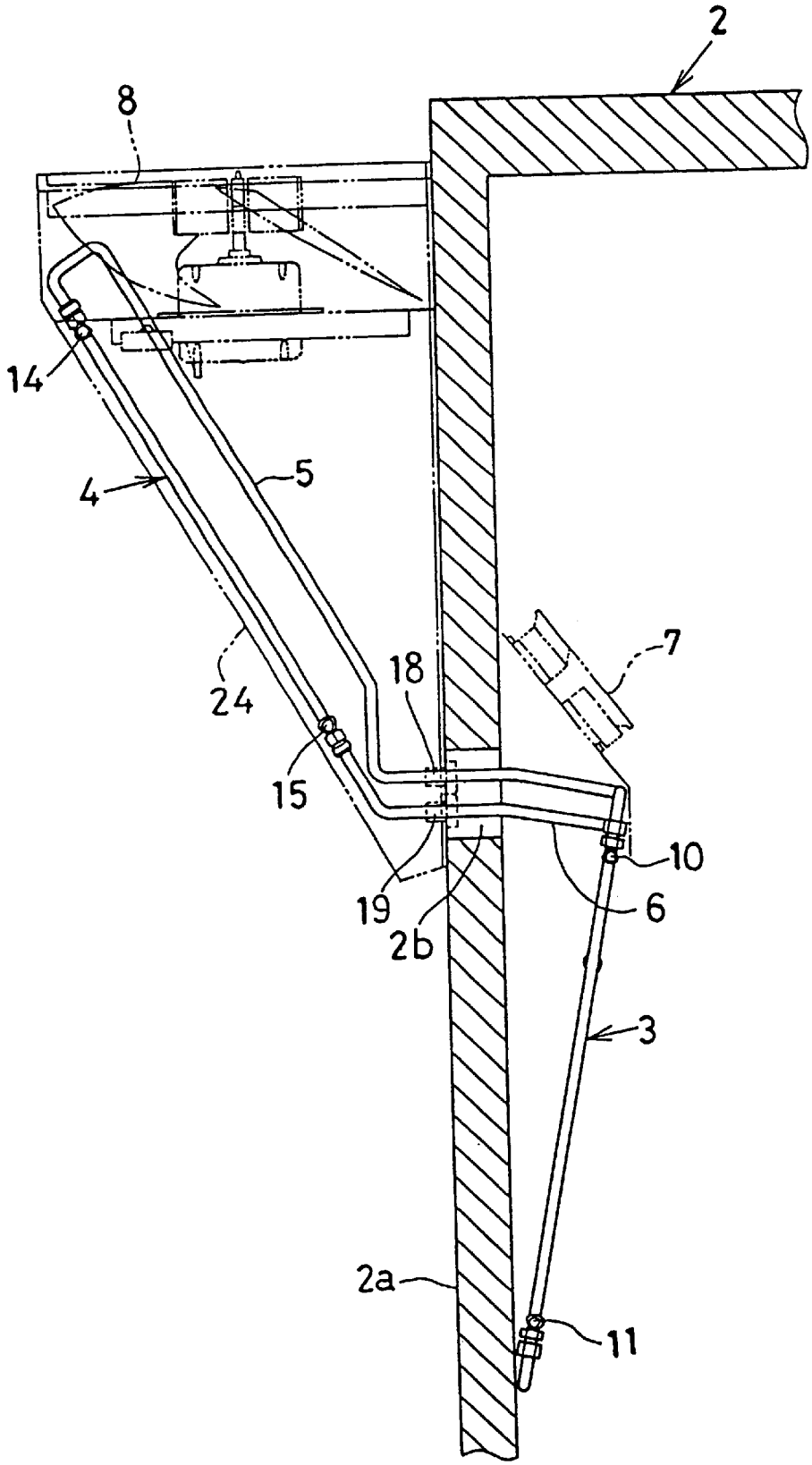
FIG. 2 is a side view showing the cooling device of the first embodiment.

A first preferred embodiment of the present invention will be now described with reference to FIGS. 1–4. As shown in FIGS. 1 and 2, a cooling device 1 includes a boiling unit 3 (high-temperature side heat exchanger, first heat exchanger) disposed inside a sealed housing 2, a condensing unit 4 (low-temperature side heat exchanger, second heat exchanger) disposed outside the housing 2, a connection pipe for connecting the boiling unit 3 and the condensing unit 4, an interior fan 7 for blowing air toward the boiling unit 3, and an exterior fan 8 for blowing air toward the condensing unit 4. The connection pipe has a gas-refrigerant introduction pipe 5 for introducing gas refrigerant from the boiling unit 3 into the condensing unit 4, and a liquid-refrigerant introduction pipe 6 for introducing liquid refrigerant from the condensing unit 4 into the boiling unit 3. Further, the interior fan 7 is disposed inside the housing 2, and the exterior fan 8 is disposed outside the housing 2. A predetermined amount of refrigerant such as HFC-134a is sealed in a refrigerant passage formed by the boiling unit 3, the condensing unit 4 and the pipes 5, 6.

The housing 2 is applied to a radio base station device of a moving radio telephone such as a pocket telephone and a vehicle telephone, and accommodates therein electrical parts which performs communication operation and generates heat when an electrical power is applied thereto.

The boiling unit 3 includes a plurality of heat receiving tubes 9 disposed in parallel, upper and lower tanks 10, 11 connecting to two ends of each heat receiving tube 9 so that the heat receiving tubes 9 communicate with each other, and heat receiving fins 12 disposed between adjacent the heat receiving tubes 9. Those parts are brazed integrally to form the boiling unit 3.

Each of the heat receiving tubes 9 is made of metal, having a sufficient heat-transmission performance, such as aluminum or copper, and is formed in an elliptical shape in cross section. Each of the upper tank 10 and the lower tank 11 is made of the same metal as the heat receiving tubes 9, and is formed approximately in a cylinder shape in which both ends are closed. The ends of the heat receiving tubes 9 are inserted into the upper and lower tanks 10, 11 at a predetermined distance in a longitudinal direction of the upper and lower tanks 10, 11. As shown in FIG. 1, a connection nut 10a for connecting the gas-refrigerant introduction pipe 5 to the upper tank 10 is formed in the upper tank 10 at one end side (right end side in FIG. 1) in the longitudinal direction, and a connection nut 11*a* for connecting the liquid-refrigerant introduction pipe 6 to the lower tank 11 is formed in lower tank 11 at the other end side (left end side in FIG. 1) in the longitudinal direction. The heat receiving fins 12 are corrugated fins each of which is made of thin plate formed into a wave shape by bending the metal in alternate directions. Each of the heat receiving fins 12 is connected to wall surfaces of the heat receiving tubes 9 in the bent portions.

As shown in FIG. 2, the boiling unit 3 is attached to the housing 2 to be inclined relative to a vertical wall 2*a* of the housing 2 by a predetermined angle.

The condensing unit 4 includes a plurality of heat radiating tubes 13 disposed in parallel, upper and lower tanks 14, 15 connecting to two ends of each heat receiving tube 9 so that the heat radiating tubes 13 communicate with each other, heat radiating fins 16 disposed between adjacent the heat radiating tubes 13, and a diffusion plate 17 (see FIG. 3) for diffusing gas refrigerant in the upper tank 14. Those parts are brazed integrally to form the condensing unit 4.

Each of the heat radiating tubes 13 is made of metal, having a sufficient hear-transmission performance, such as aluminum or copper, and is formed in an elliptical shape in cross section. Each of the upper tank 14 and the lower tank 15 is made of the same metal as the heat radiating tubes 13, and is formed approximately in a cylinder shape in which both ends are closed. The ends of the heat radiating tubes 13 are inserted into the upper and lower tanks 14, 15 at a predetermined distance in a longitudinal direction of the upper and lower tanks 14, 15. As shown in FIG. 1, a connection nut 14*a* for connecting the gas-refrigerant introduction pipe 5 to the upper tank 14 is formed in the upper tank 14 at one end side (left end side in FIG. 1) in the longitudinal direction, and a connection nut 15*a* for connecting the liquid-refrigerant introduction pipe 6 to the lower tank 15 is formed in lower tank 15 at the other end side (right end side in FIG. 1) in the longitudinal direction. The heat radiating fins 16 are corrugated fins each of which is made of thin plate formed into a wave shape by bending the metal in alternate directions. Each of the heat radiating fins 16 is connected to wall surfaces of the heat radiating tubes 13 in the bent portions.

Figure 3:
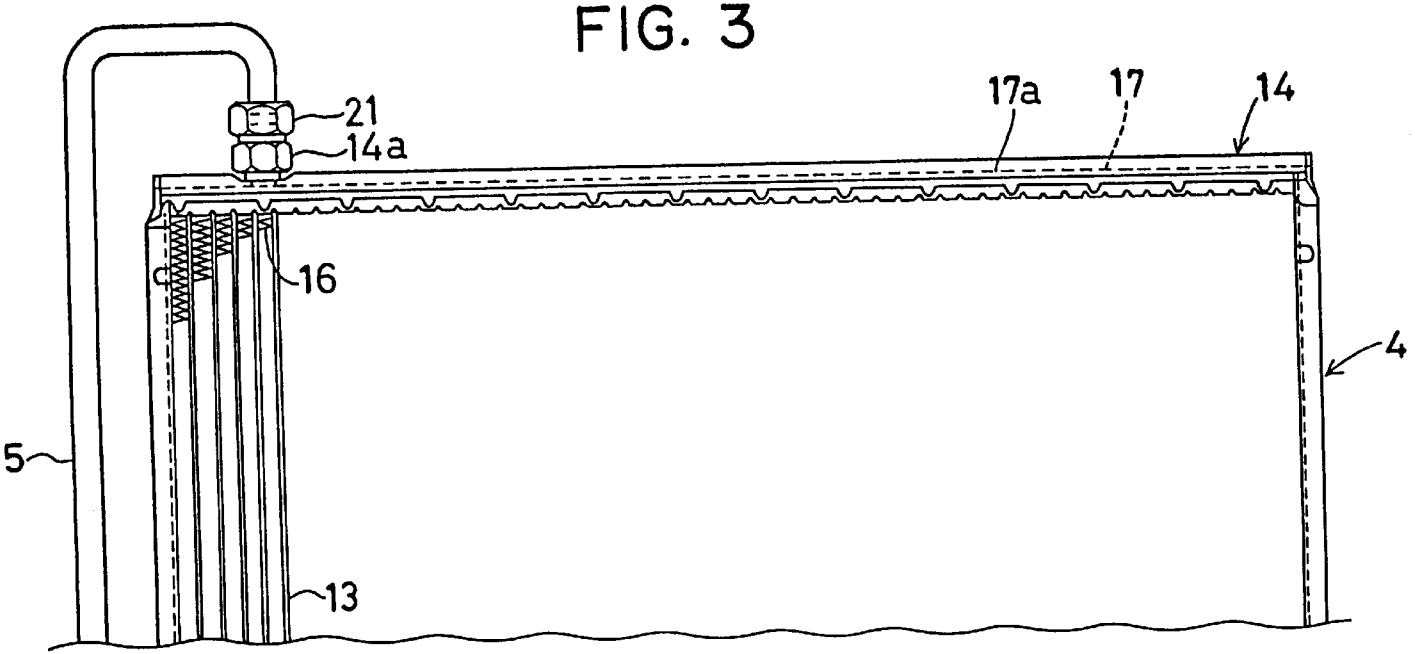
FIG. 3 is an enlarged view showing a part of a condensing unit at an upper tank side according to the first embodiment.
Figure 4:
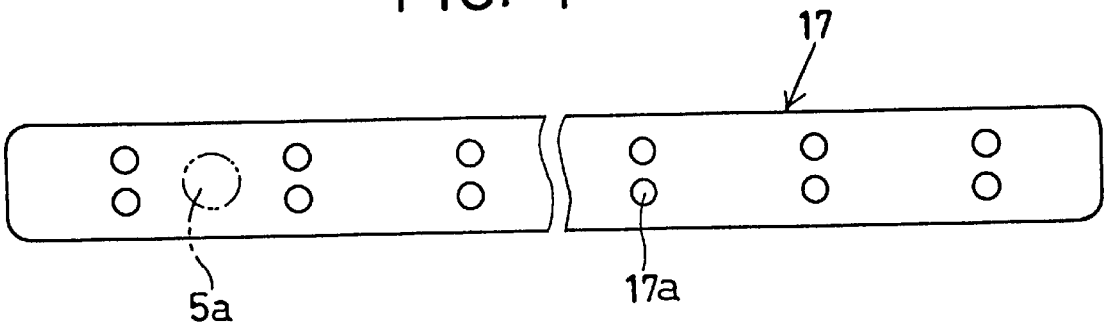
FIG. 4 is a front view of a diffusion plate according to the first embodiment.

As shown in FIG. 3, the diffusion plate 17 is formed into a thin-long shape to correspond to an inner shape of the upper tank 14 of the condensing unit 4. The diffusion plate 17 is disposed in the upper tank 14 at an approximate center in an up-down direction in FIG. 3 so that an inner space of the upper tank 14 is divided into upper and lower parts. As shown in FIG. 4, a plurality of round holes 17*a* are formed in the diffusion plate 17 over an all length in the longitudinal direction. Each of the round holes 17*a* has an opening area smaller than that of an introduction port 5*a* of the gas-refrigerant introduction pipe 5. The introduction port 5*a* of the gas-refrigerant introduction pipe 5 is opened into the upper tank 14 of the condensing unit 4. As shown in FIG. 3, any one of the round holes 17*a* is not provided at a position opposite to the introduction port 5*a* of the gas-refrigerant introduction pipe 5.

As shown in FIG. 2, the condensing unit 4 is disposed at a position higher than the boiling unit 3 in a vertical direction of the housing 2, and is attached to the vertical wall 2*a* of the housing 2 to be inclined to a side opposite to the boiling unit 3 by a predetermined angle.

The gas-refrigerant introduction pipe 5 is for introducing gas refrigerant boiled in the boiling unit 3 into the condensing unit 4, and the liquid-refrigerant introduction pipe 6 is for introducing liquid refrigerant condensed in the condensing unit 4 into the boiling unit 3. Each of the gas-refrigerant introduction pipe 5 and the liquid-refrigerant introduction pipe 6 is formed by cutting a metal pipe to have a predetermined distance. As shown in FIG. 2, each of the gas-refrigerant introduction pipe 5 and the liquid-refrigerant introduction pipe 6 penetrates through a through hole 2*b* formed in the vertical wall 2*a* of the housing 2, and connects the boiling unit 3 and the condensing unit 4. The through hole 2*b* of the vertical wall 2*a* of the housing 2 is air-tightly closed by unions 18, 19 brazed to outer peripherals of the gas-refrigerant introduction pipe 5 and the liquid-refrigerant introduction pipe 6.

One end of the gas-refrigerant introduction pipe 5 is detachably connected to the connection nut 10*a* at the upper tank 10 of the boiling unit 3 through a joint member 20, and the other end thereof is detachably connected to the connection nut 14*a* at the upper tank 14 of the condensing unit 4 through a joint member 21.

One end of the liquid-refrigerant introduction pipe 6 is detachably connected to the connection nut 15*a* at the lower tank 15 of the condensing unit 4 through a joint member 22, and the other end thereof is detachably connected to the connection nut 11*a* at the lower tank 11 of the boiling unit 3 through a joint member 23.

The interior fan 7 includes a plurality of axial flow fans, for example, and is disposed within the housing 2 at an upper side of the boiling unit 3 so that air within the housing 2 is blown into the boiling unit 3. Therefore, air having a high temperature, within the housing 2, is cooled while passing through the boiling unit 3.

The exterior fan 8 is an axial flow fan having a diameter larger than the interior fan 7, for example. The exterior fan 8 is attached at an upper side of condensing unit 4 so that outside air (i.e., air outside the housing 2) is blown into the condensing unit 4. As shown in FIG. 2, the exterior fan a is accommodated in a casing 24 with the condensing unit 4, and is fixed to the vertical wall 2*a* of the housing 2 through the casing 24. The interior fan 7 and the exterior fan 8 are electrically controlled by a control unit (not shown) based on a temperature within the housing 2, detected by a temperature sensor such as a thermistor.

The operation of the cooling device 1 according to the first embodiment will be now described.

When the inner temperature of the housing 2 is increased by heat generated from the electrical parts and electrical power is supplied to the interior fan 7 and the exterior fan 8 through the control unit, inside air (i.e., air inside the housing 2) within the housing 2 is blown toward the boiling unit 3 by the interior fan 7, and outside air is blown into the condensing unit 4 by the exterior fan 8. Therefore, liquid refrigerant in each the heat receiving tube 9 of the boiling unit 3 is boiled and evaporated by receiving heat from air having a high temperature. The evaporated gas refrigerant (i.e., refrigerant vapor) in each of the heat receiving tubes 9 rises upwardly, and flows from the upper tank 10 of the boiling unit 3 into the upper tank 14 of the condensing unit 4 through the gas-refrigerant introduction pipe 5.

The evaporated gas refrigerant flowing into the upper tank 14 of the condensing unit 4 is distributed into each of the heat radiating tubes 13 from the upper tank 14, and is cooled and condensed on inner walls of the heat radiating tubes 13 by outside air blown from the exterior fan 8 while passing through each of the heat radiating tubes 13. The condensed liquid refrigerant drops to the lower tank 15 of the condensing unit 4 along the inner walls of the heat radiating tubes 13. The condensed liquid refrigerant in the lower tank 15 of the condensing unit 4 flows into the lower tank 11 of the boiling unit 3 through the liquid-refrigerant introduction pipe 6, and is supplied to each of the heat receiving tubes 9 of the boiling unit 3 to repeat the above-described refrigerant cycle.

By repeating the boiling and the condensing of the refrigerant during circulating between the boiling unit 3 and the condensing unit 4, heat generated from the electrical parts (heat-generating member) can be radiated to the outside of the housing 2 so that the electrical parts accommodated in the housing 2 is cooled.

According to the first embodiment of the present invention, the diffusion plate 17 is disposed in the upper tank 14 of the condensing unit 4 so that upper and lower spaces are defined by the diffusion plate 17 in the upper tank 14. Therefore, gas refrigerant (i.e., refrigerant vapor) introducing into the upper tank 14 from the gas-refrigerant introduction pipe 5 flows into the lower space of the upper tank 14 through the round holes 17*a* formed in the diffusion plate 17, while being diffused to all the upper space of the upper tank 14 along a surface of the diffusion plate 17. AS a result, gas refrigerant approximately uniformly flows through all the heat radiating tubes 13 of the condensing unit 4, and gas refrigerant can be effectively condensed in an entire area of the condensing unit 4. Thus, heat-radiating performance of refrigerant in the condensing unit 4 can be improved.

Further, because any a round hole 17*a* is not provided at a position opposite to the introduction port 5*a* of the gas-refrigerant introduction pipe 5, it can prevent gas refrigerant introduced into the upper tank 14 from directly flowing into the heat radiating tubes 13 after linearly passing through the round hole 17*a* of the diffusion plate 17. That is, if the round hole 17*a* is formed in the diffusion plate 17 at the position opposite to the introduction port 5*a* of the gas-refrigerant introduction pipe 5, a part of gas refrigerant introduced into the upper tank 14 directly passes through the round hole 17*a*; and therefore, gas-refrigerant diffusion performance due to the diffusion plate 17 is decreased. However, according to the first embodiment of the present invention, any one of the round holes 17*a* is not provided at the position opposite to the introduction port 5*a* of the gas-refrigerant introduction pipe 5. Thus, the gas-refrigerant diffusion performance in the upper tank 14 can be improved.

In the first embodiment, a plurality of the round holes 17*a* are provided in the diffusion plate 17 to diffuse gas refrigerant. However, the diffusion plate 17 may be formed in a mesh like or a louver like, for example. Further, a small opening having an opening area greatly smaller than the opening area of the round hole 17*a* may be formed in the diffusion plate 17 at the position opposite to the introduction port 5*a* of the gas-refrigerant introduction pipe 5. That is, the diffusion plate 17 may be formed to have a flow resistance for resisting gas refrigerant flowing through the diffusion plate 17 at the position opposite to the introduction port 5*a* of the gas-refrigerant introduction pipe 5.

Figure 5:
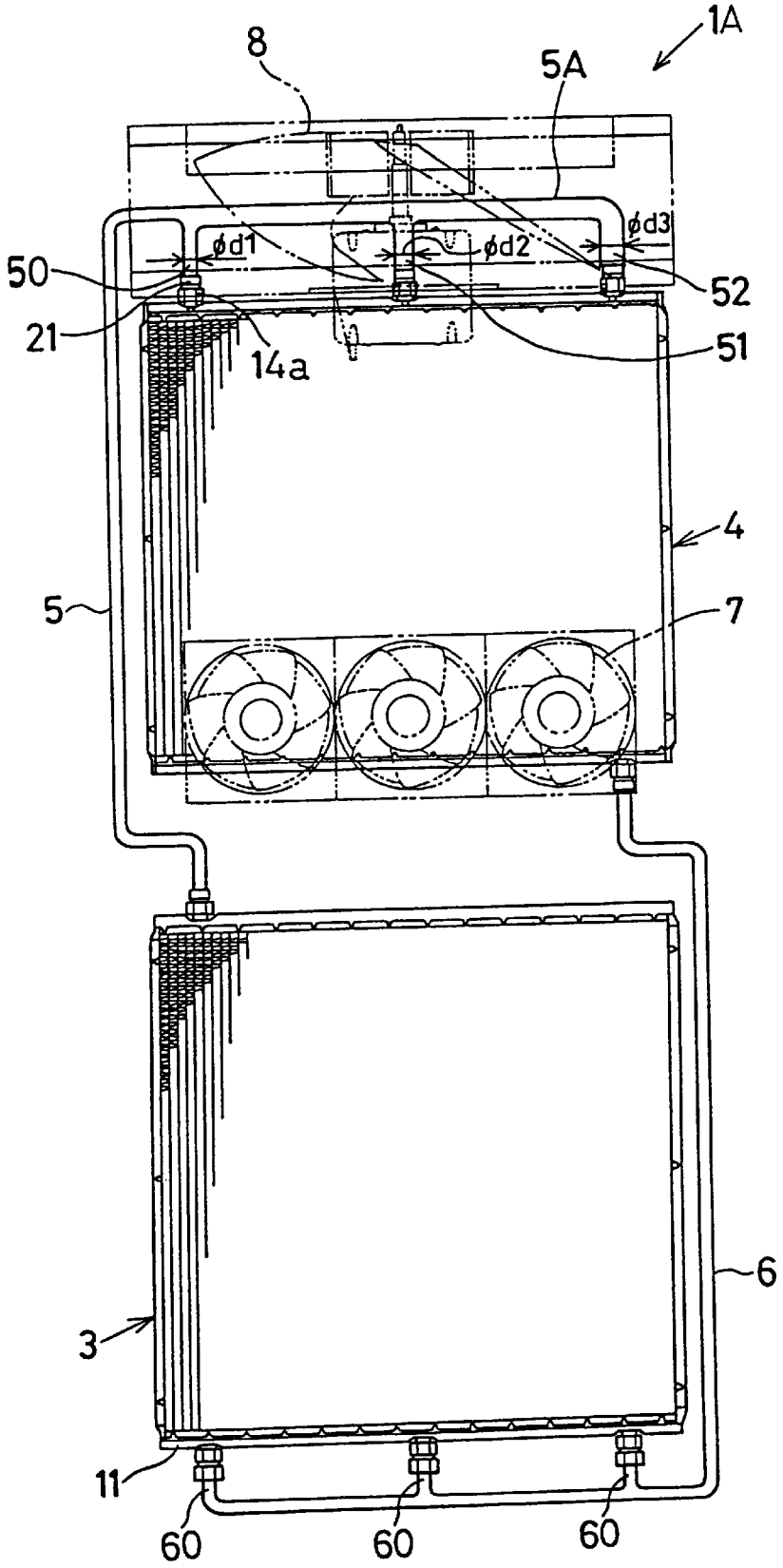
FIG. 5 is front view showing a cooling device according to a second preferred embodiment of the present invention.

A second preferred embodiment of the present invention will be now described with reference to FIG. 5. In this and following embodiments components which are similar to those in the first embodiment are indicated with the same reference numerals, and the explanation thereof is omitted. In the second embodiment, a cooling unit 1A includes the boiling unit 3 and the condensing unit 4. As shown in FIG. 5, the gas-refrigerant introduction pipe 5 has an upper pipe portion 5A, and three end pipes are branched from the upper pipe portion 5A. That is, the three end pipes are a first end pipe 50, a second end pipe 51, and a third end pipe 52. The end pipes 50, 51, 52 are detachably connected to three connection nuts 14*a* formed in the upper tank 14, respectively, through joint members 21.

The first end pipe 50 is provided in the upper pipe portion 5A of the gas-refrigerant introduction pipe 5 at an upstream refrigerant side, the second end pipe 51 is provided in the upper pipe portion 5A at a downstream refrigerant side of the first end pipe 50, and the third end pipe 52 is provided in the upper pipe portion 5A at a downstream refrigerant side of the second end pipe 51. The second end pipe 51 is connected to an approximate center of the upper tank 14 in the longitudinal direction of the upper tank 14, and the first and third end pipes 50, 52 are connected to both end portions of the upper tank 14 in the longitudinal direction thereof. Further, when a diameter of the first end pipe 50 is d1; a diameter of the second end pipe 51 is d2; and a diameter of the third end pipe 52 is d3, those diameters has the relationship of d1<d2<d3.

According to the second embodiment, because gas refrigerant is introduced into the upper tank 14 from the three end pipes 50, 51, 52, it can prevent gas refrigerant from mainly flowing into an inlet side of the upper tank 14. Further, because the diameters of the three end pipes 50–52 have the relationship of d1<d2<d3, that is, because the third end pipe 52 at a downstream refrigerant side has a diameter larger than that of the first end pipe 50 at an upstream refrigerant side, gas refrigerant can be approximately uniformly introduced into the upper tank 14 from the three end pipes 50–52. As a result, gas refrigerant introduced into the upper tank 14 can be uniformed diffused, the all area of the condensing unit 4 can be effectively used, and heat-radiating performance of gas refrigerant in the condensing unit 4 can be improved.

Similarly to the gas-refrigerant introduction pipe 5, the liquid-refrigerant introduction pipe 6 may be provided with a plurality of end pipes 60, and the end pipes 60 may be connected to the lower tank 11 of the boiling unit 3, as shown in FIG. 5.

In the above-described second embodiment, a plurality end pipes 50–52 are provided in the gas-refrigerant introduction pipe 5 and a plurality end pipes 60 are provided in the liquid-refrigerant introduction pipe 6. However, the boiling unit 3 and the condensing unit 4 may be connected using a plurality of the gas-refrigerant introduction pipes 5 and a plurality of the liquid-refrigerant introduction pipes 6 without using the end pipes.

Figure 6:
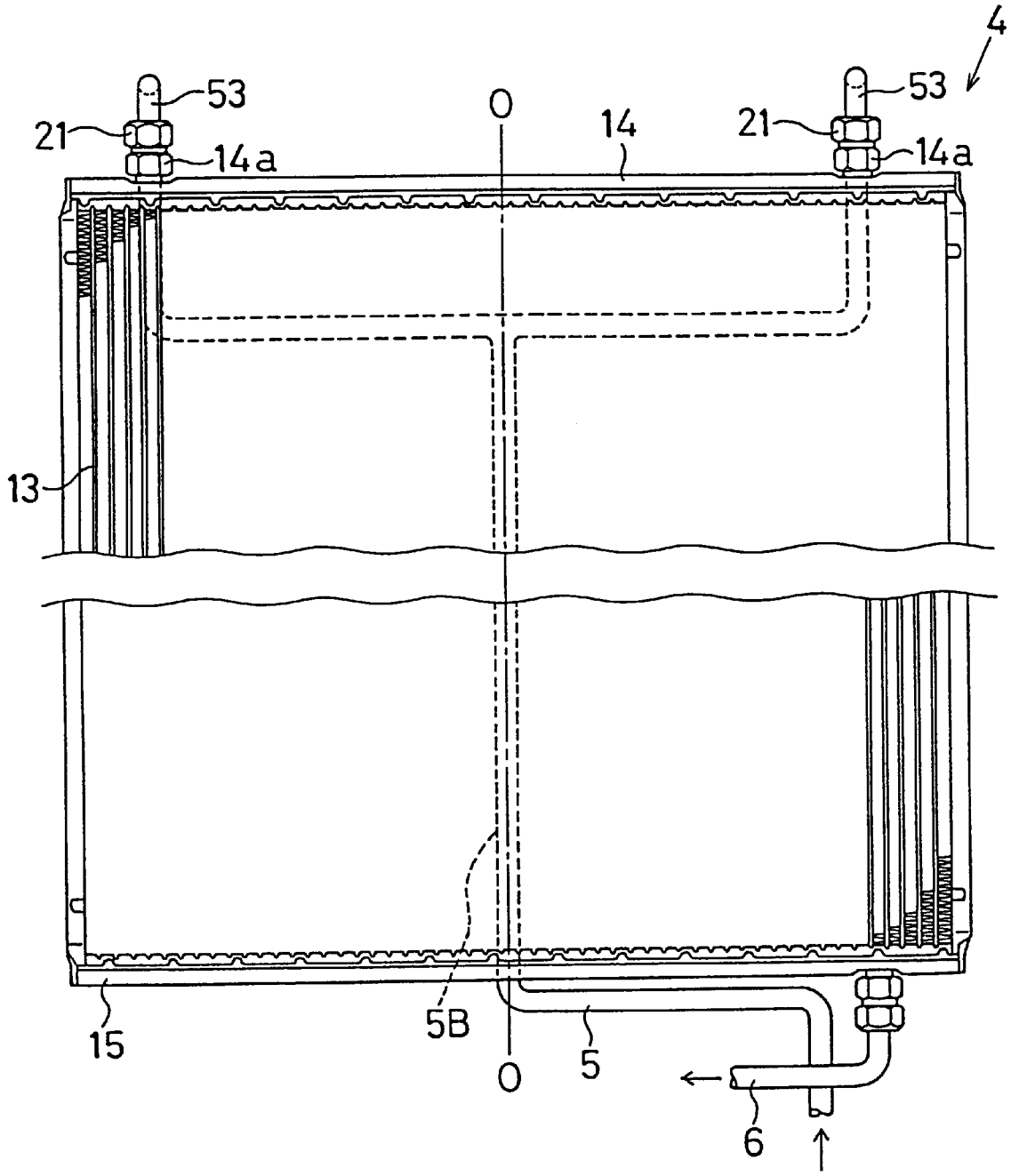
FIG. 6 is a front view showing a condensing unit according to a third preferred embodiment of the present invention.
Figure 7:
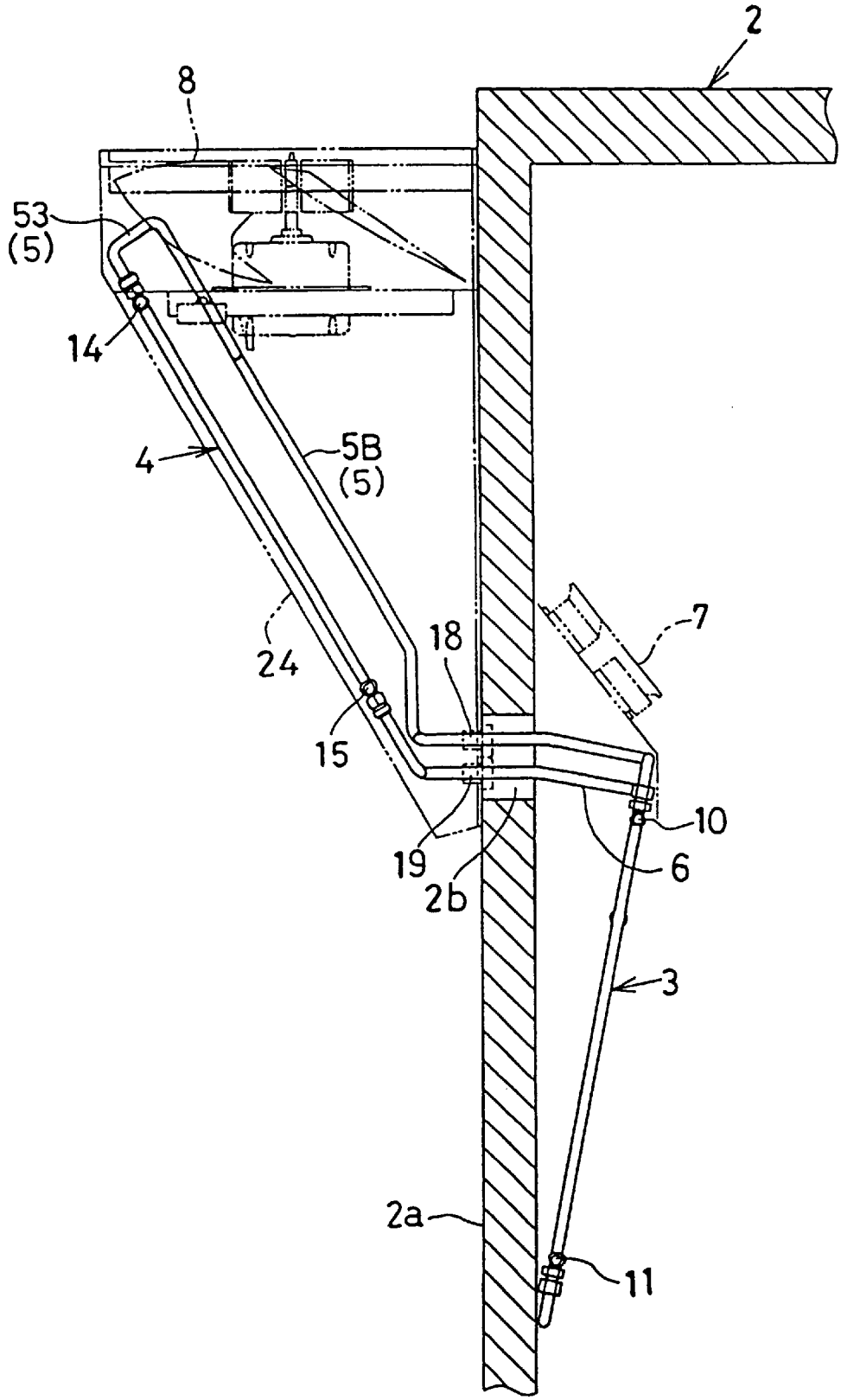
FIG. 7 is a side view showing a cooling device according to the third embodiment.

A third preferred embodiment of the present invention will be now described with reference to FIGS. 6, 7, 8A, 8B. In the third embodiment, the gas-refrigerant introduction pipe 5 is branched into two branched pipes relative to the upper tank 14 of the condensing unit 4. As shown in FIG. 6, the gas-refrigerant introduction pipe 5 includes a vertical pipe portion 5B extending in an up-down direction in FIG. 6, and two branched pipes 53 branched from an upper end of the vertical pipe portion 5B. The vertical pipe portion 5B and the branched pipes 53 are connected in a T-shape. Each branched pipe 53 of the gas-refrigerant introduction pipe 5 is detachably connected to the connection nut 14*a* through the joint member 21.

Further, the liquid-refrigerant introduction pipe 6 is connected to the lower tank 15 of the condensing unit 4 at a position similar to the right side branched pipe 53 in the longitudinal direction of the upper and lower tanks 14, 15. That is, the liquid-refrigerant introduction pipe 6 is disposed in such a manner that the position relationship between the liquid-refrigerant introduction pipe 6 and the right side branched pipe 53 relative to a center line O in FIG. 6 is different from the position relationship between the liquid-refrigerant introduction pipe 6 and the left side branched pipe 53 relative to the center line O.

In the third embodiment, because the liquid-refrigerant introduction pipe 6 and each branched pipe 53 of the gas-refrigerant introduction pipe 5 are disposed in the condensing unit 4 to be left-right unsymmetrical relative to the center line O, it can restrict a convection between gas refrigerant and condensed liquid refrigerant in the condensing unit 4. Thus, it can prevent condensed liquid refrigerant from staying in a part of the heat radiating tubes 13, and all area of the condensing unit 4 can be effectively used. That is, in the third embodiment, the liquid-refrigerant introduction pipe 6 is disposed left-right unsymmetrically relative to both the branched pipes 53 of the gas-refrigerant introduction pipe 5

Further, because the liquid-refrigerant introduction pipe 6 connected to the lower tank 15 of the condensing unit 4 and the right side branched pipe 53 connected to the upper tank 14 are disposed to be opposite to each other through the heat radiating tubes 13, the pressure of gas refrigerant flowing into the upper tank 14 from the gas-refrigerant introduction pipe 5 is added to the condensed liquid refrigerant within the liquid-refrigerant introduction pipe 6 through the heat radiating tubes 13. As a result, it can prevent a surface of liquid refrigerant in the liquid-refrigerant introduction pipe 6 from rising.

Figure 8B:
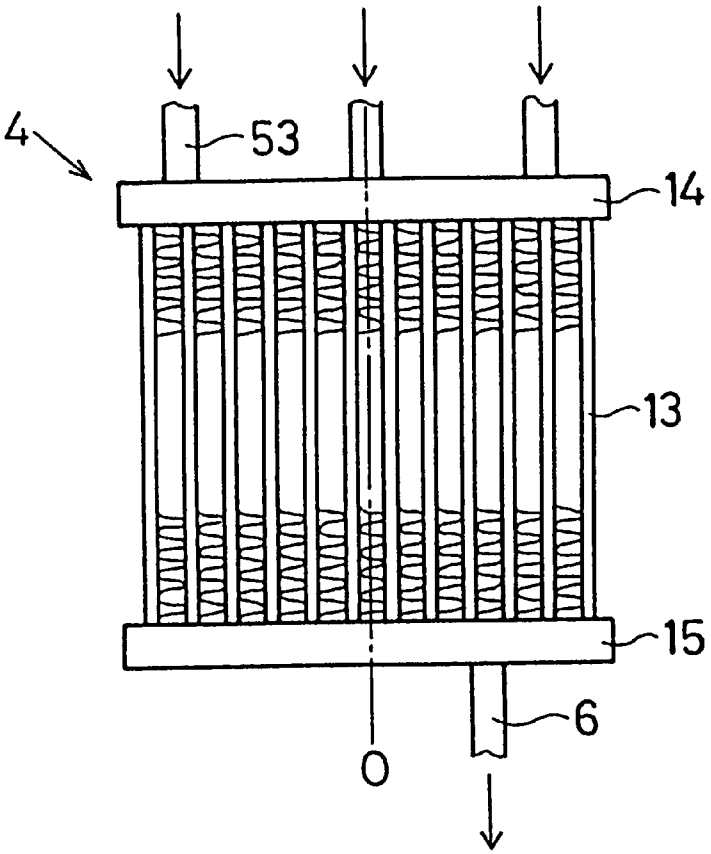
FIGS. 8A, 8B are front views of condensing units, respectively, according to the third embodiment.
Figure 8A:
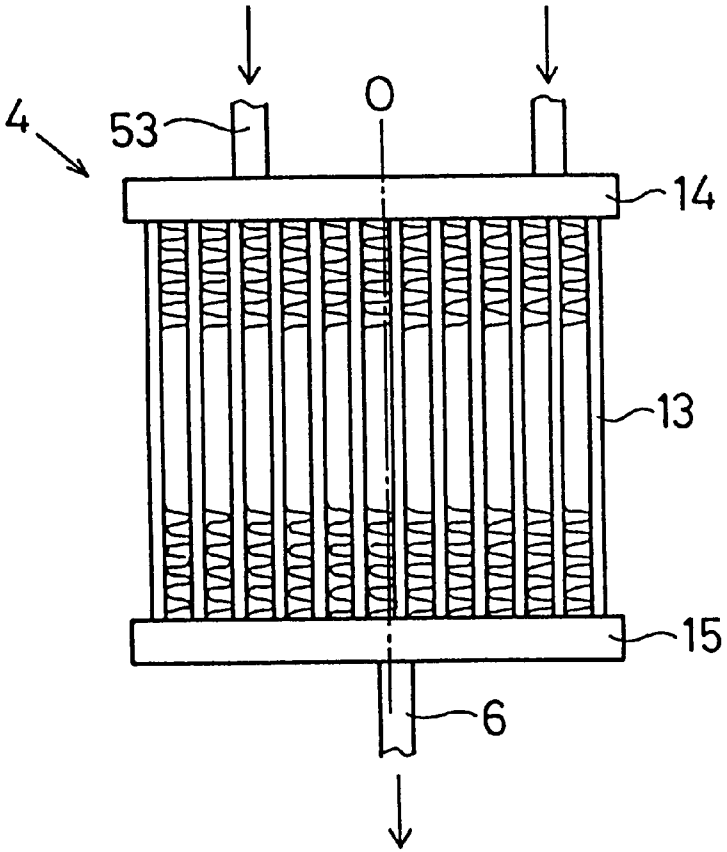

In the third embodiment, the left-right unsymmetrical structure of the liquid-refrigerant introduction pipe 6 relative to the both branched pipes 53 of the upper tank 14 is described with reference to FIG. 6. However, the left-right unsymmetrical structure may be formed as shown in FIGS. 8A, 8B, for example. That is, as shown in FIG. 8A, the liquid-refrigerant introduction pipe 6 is disposed in the lower tank 15 at the center line O, and the both branched pipes 53 connected to the upper tank 14 is disposed unsymmetrically relative to the center line O. Further, as shown in FIG. 8B, when three branched pipes 53 branched from the gas-refrigerant introduction pipe 5 are connected to the upper tank 14 of the condensing unit 4, the liquid-refrigerant introduction pipe 6 is disposed left-right unsymmetrically relative to the center line O.

Figure 9B:
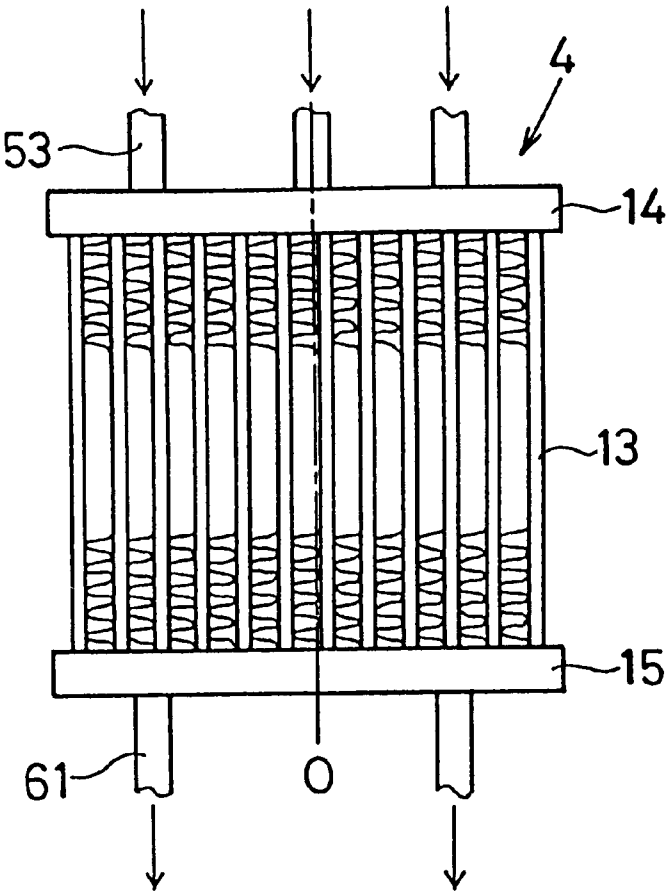
FIGS. 9A, 9B are front views of condensing units, respectively, according to a fourth preferred embodiment of the present invention.
Figure 9A:
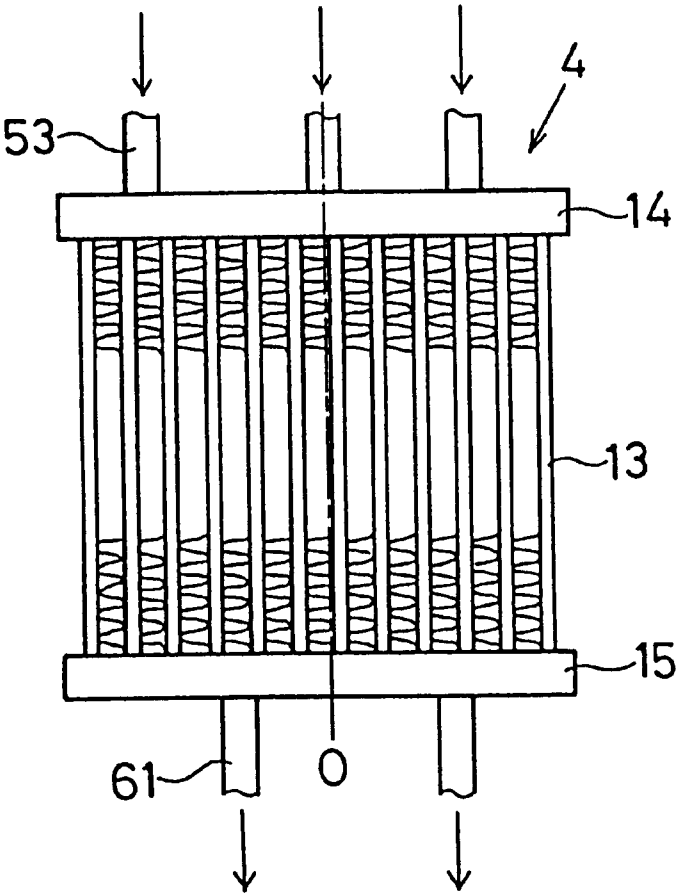
Figures 10A, 10B, 10C:
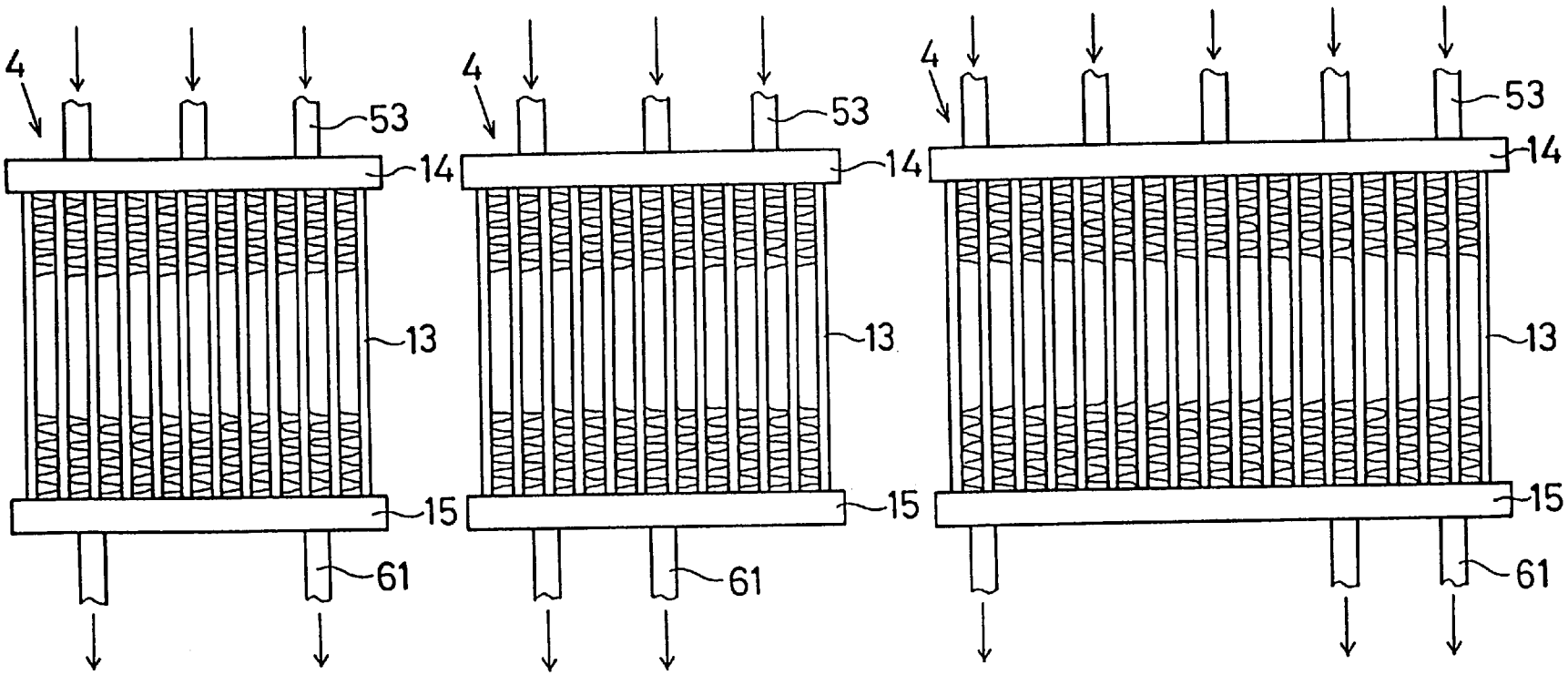
FIGS. 10A, 10B, 10C are front views of condensing units, respectively, according to the fourth embodiment.

A fourth preferred embodiment of the present invention will be now described with reference to FIGS. 9A–9B, 10A–10C. In the fourth embodiment, a plurality of branched pipes 61 are branched from the liquid-refrigerant introduction pipe 6, and are connected to the lower tank 15 of the condensing unit 4. However, in the fourth embodiment, the number of branched pipes 61 of the liquid-refrigerant introduction pipe 6 is set to be smaller than the number of the branched pipes 53 of the gas-refrigerant introduction pipe 5. For example, in FIG. 9A, the positions of two branched pipes 61 of the liquid-refrigerant introduction pipe 6, connected to the lower tank 15 are different from the positions of three branched pipes 53 of the gas-refrigerant introduction pipe 5, connected to the upper tank 14, in the longitudinal direction of the upper and lower tanks 14, 15. In FIG. 9B, the positions of the two branched pipes 53 connected to the upper tank 14, approximately correspond to the positions of two branched pipes 61 connected to the lower tank 15 in the longitudinal direction of the upper and lower tanks 14, 15. In FIG. 10A, the positions of the two branched pipes 53 connected to the upper tank 14, approximately correspond to the positions of two branched pipes 61 connected to the lower tank 15 in the longitudinal direction of the upper and lower tanks 14, 15, similarly to FIG. 9. Further, in FIG. 10A, the three branched pipes 53 are connected to the upper tank 14 to approximately have the same distance between adjacent branched pipes 53. Further, the branched pipes 53 of the gas-refrigerant introduction pipe 5 and the branched pipes 61 of the liquid-refrigerant introduction pipe 6 may be disposed as shown in FIGS. 10B, 10C.

Thus, in the fourth embodiment, because a plurality of the branched pipes 53 of the gas-refrigerant introduction pipe 5 and a plurality of branched pipes 61 of the liquid-refrigerant introduction pipe 6 are used, the heat-radiating performance of refrigerant in the condensing unit 4 can be improved.

Figure 11:
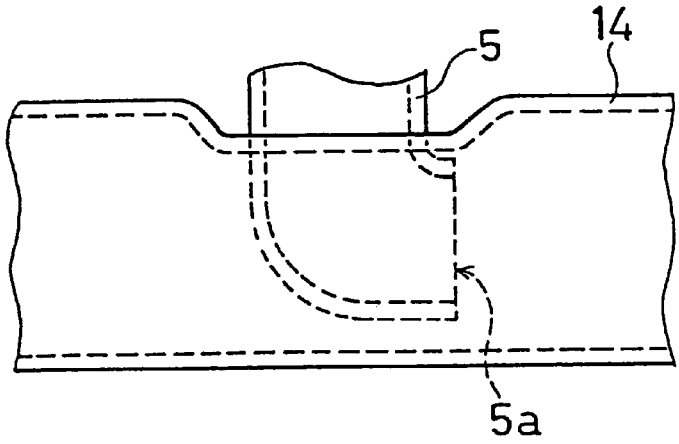
FIG. 11 is a side view showing a top end of a gas-refrigerant introduction pipe according to a fifth preferred embodiment of the present invention.
Figure 12A:
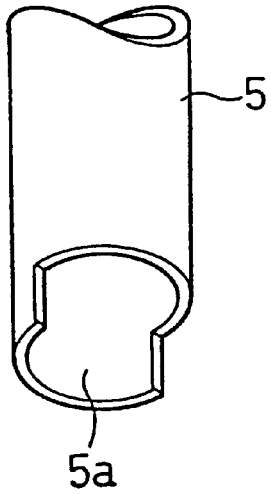
FIGS. 12A, 12B are perspective views showing top ends of gas-refrigerant introduction pipes, respectively, according to the fifth embodiment.
Figure 12B:
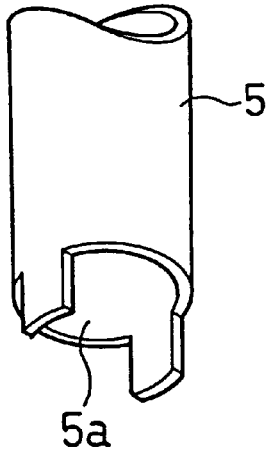

A fifth preferred embodiment of the present invention will be described with reference to FIGS. 11, 12A, 12B. In the fifth embodiment, a top end of the gas-refrigerant introduction pipe 5, opened in the upper tank 14 of the condensing unit 4, is mainly described. As shown in FIG. 11, the top end of the gas-refrigerant introduction pipe 5 is opened in the upper tank 14 of the condensing unit 4 toward the longitudinal direction of the upper tank 14. Therefore, gas refrigerant introduced into the upper tank 14 from the gas-refrigerant introduction pipe 5 readily flows in the upper tank 14 in the longitudinal direction, and gas refrigerant can be readily diffused in all area of the upper tank 14. Thus, the heat-radiating performance of refrigerant in the condensing unit 4 can be improved. Further, the top end of the gas-refrigerant introduction pipe 5, opened in the upper tank 14 may be formed in the shapes shown in FIGS. 12A, 12B so that gas refrigerant introduced into the upper tank 14 readily flows in the upper tank 14. For example, one side wall of the gas-refrigerant introduction pipe 5 is cut at the top end as shown in FIG. 12A, and both side walls of the gas-refrigerant introduction pipe 5 are cut at the top end as shown in FIG. 12B.

Figure 13A:
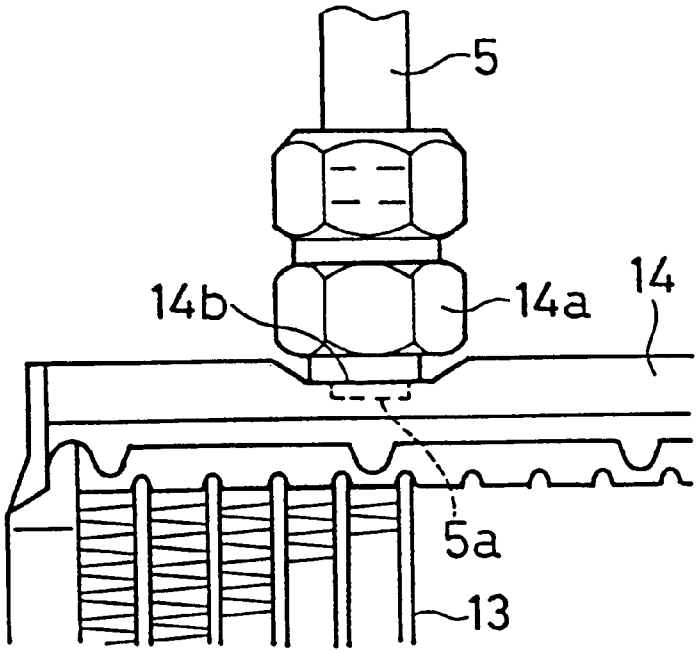
FIG. 13A is a side view of a receiving portion of an upper tank for a comparison with a sixth preferred embodiment.

A sixth preferred embodiment of the present invention will be now described with reference to FIGS. 13A, 13B. In the sixth embodiment, a receiving portion 14*b* for fixing the connection nut 14*a* to the upper tank 14 is described. The receiving portion 14*b* is formed on the upper tank 14 in flat. When an upper surface of the upper tank 14 is recessed so that the receiving portion 14*b* is formed in the recess portion as shown in FIG. 13A, the opening position of the top end of the gas-refrigerant introduction pipe 5 in the upper tank 14 is lowered by the recess portion. Therefore, a distance between a top end of the heat radiating tube 13 and the top end of the gas-refrigerant introduction pipe 5 in the upper tank 14 in the up-down direction becomes smaller.

Figure 13B:
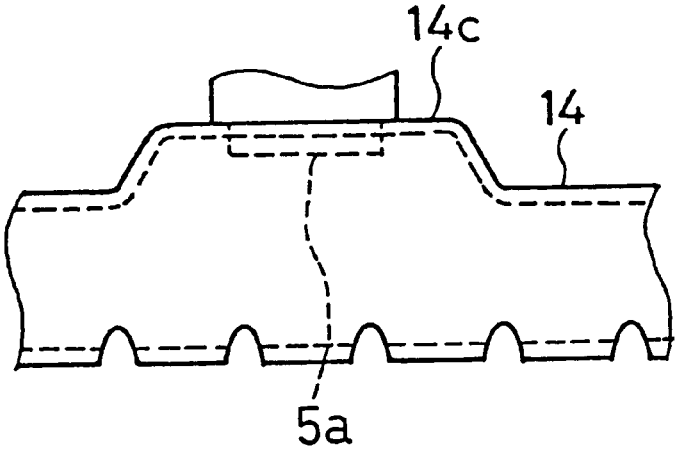
FIG. 13B is a side view of a receiving portion of an upper tank according to the sixth embodiment.

In the sixth embodiment, as shown in FIG. 13B, the receiving portion 14*c* is formed on the upper surface of the upper tank 14 to protrude from the upper surface to the outside. Therefore, the position of the top end 5*a* of the gas-refrigerant introduction pipe 5 can be made higher as compared with the case shown in FIG. 13A. Thus, a distance between the top end 5*a* of the gas-refrigerant introduction pipe 5 and each top end of the heat radiating tubes 13 in the upper tank 14 in the up-down direction becomes larger, and gas refrigerant can be readily flows through the upper tank 14.

Figure 14A:
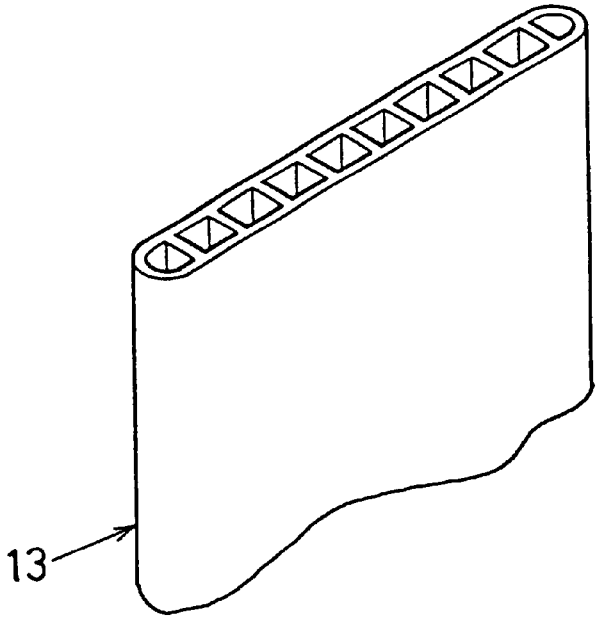
FIGS. 14A, 14B are perspective views showing end portions of refrigerant tubes, respectively, according to a seventh preferred embodiment of the present invention.

A seventh preferred embodiment of the present invention will be described with reference to FIGS. 14A, 14B, 15. In the seventh embodiment, the shape of each top end of the heat radiating tubes 13, connected to the upper tank 14, is changed so that gas refrigerant can be readily flows through the upper tank 14 of the condensing unit 4. Generally, the top end surface of the heat radiating tube 13, to be connected to the upper tank 14 of the condensing unit 4 is cut approximately vertically as shown in FIG. 14A. In this case, as shown in FIG. 15, each top end of the heat radiating tubes 13 protrudes into the upper tank 14 by a predetermined length. Therefore, a distance L1 between each top end surface of the heat radiating tube 13 and an upper wall surface of the upper tank 14 becomes smaller, and the flow of gas refrigerant in the upper tank 14 is restricted.

Figure 14B:
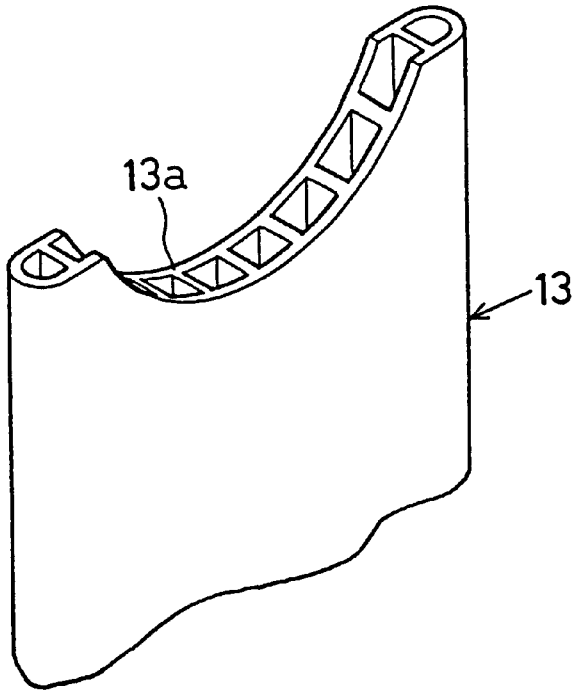
Figure 15:
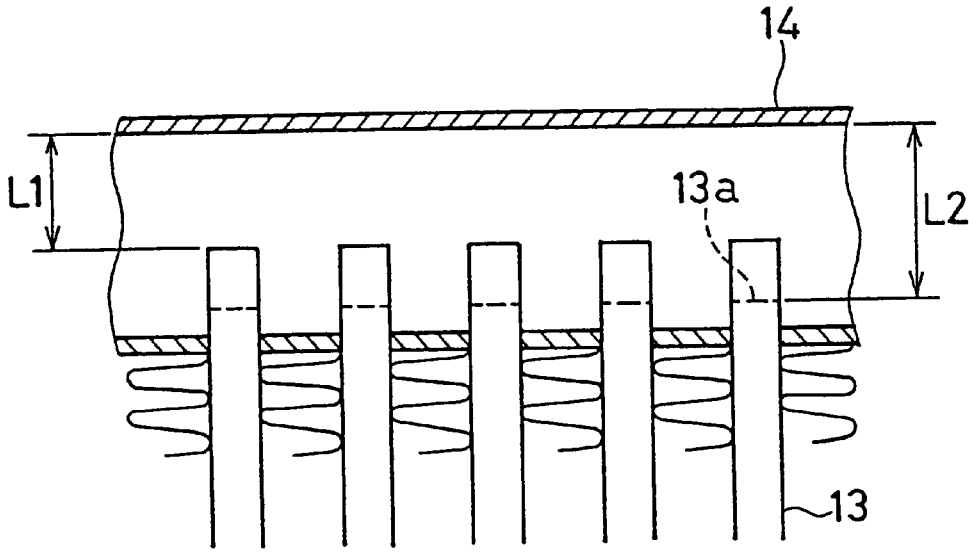
FIG. 15 is a schematic sectional view showing an upper tank of a condensing unit according to the seventh embodiment.

In the seventh embodiment, as shown in FIG. 14B, a recess portion 13*a* is formed at a center top end of the heat radiating tube 13. Therefore, as shown in FIG. 15, a distance L2 between the center top end of the heat radiating tube 13 at the recess portion 13*a* and the upper wall surface of the upper tank 14 becomes larger. Thus, gas refrigerant readily flows through the upper tank 14, and can be readily diffused into all the upper tank 14.

Figure 16:
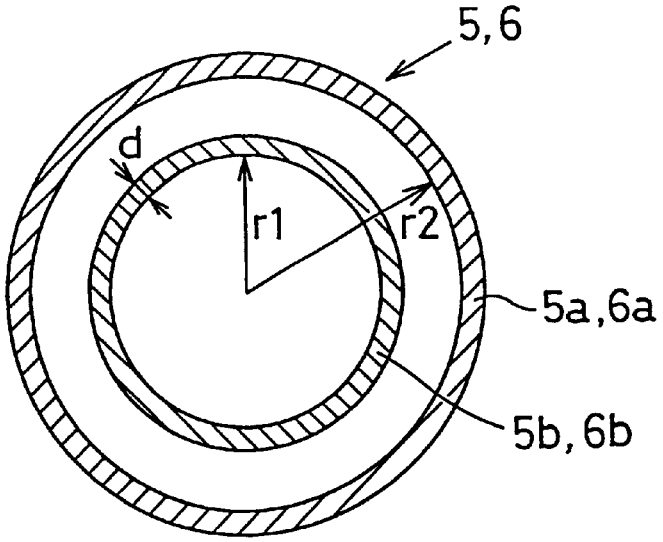
FIG. 16 is a cross-sectional view showing a connection pipe in a radial direction according to an eighth preferred embodiment of the present invention.
Figure 17:
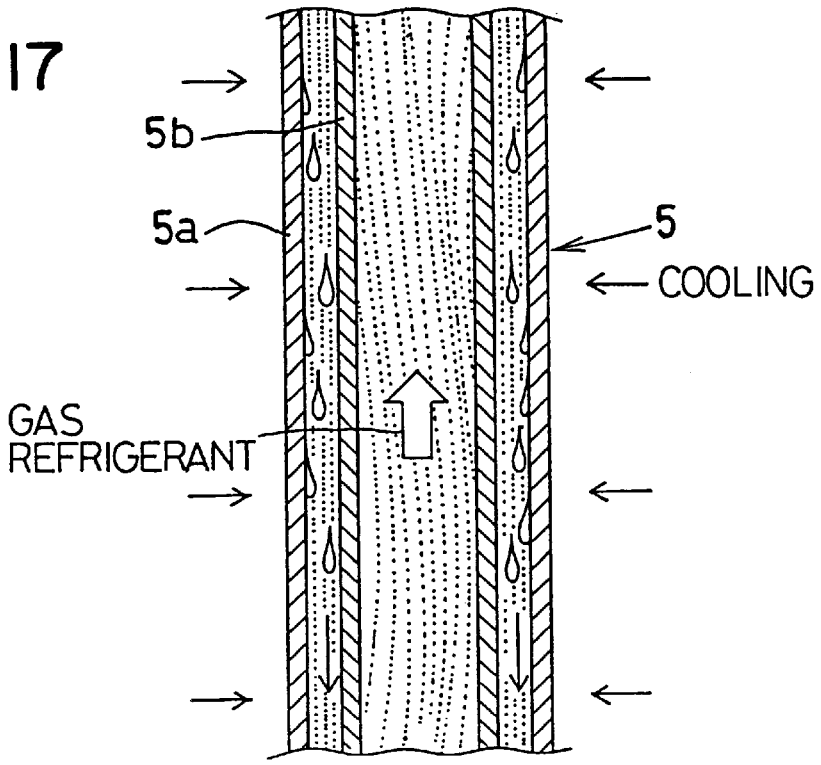
FIG. 17 is a vertical sectional view showing a gas-refrigerant introduction pipe according to the eighth embodiment.
Figure 18:
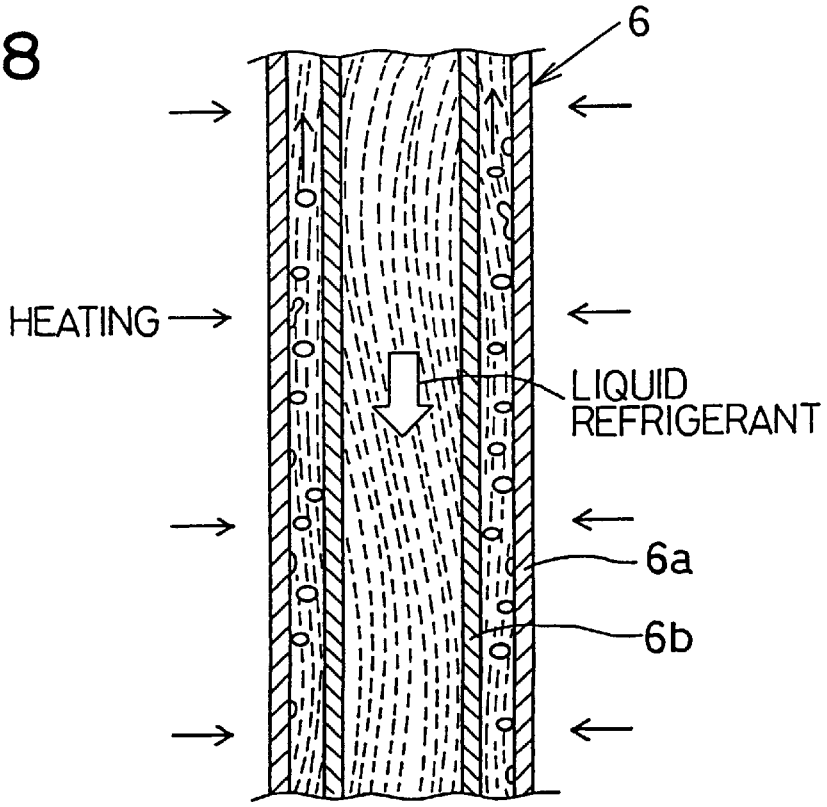
FIG. 18 is a vertical sectional view showing a liquid-refrigerant introduction pipe according to the eighth embodiment.

An eighth preferred embodiment of the present invention will be now described with reference to FIGS. 16–18. In the eighth embodiment, the connection pipe such as the gas-refrigerant introduction pipe 5 and the liquid-refrigerant introduction pipe 6 is mainly described. As shown in FIG. 16, each of the gas-refrigerant introduction pipe 5 and the liquid-refrigerant introduction pipe 6 is formed into a concentric double-pipe shape having an outer pipe 5*a*, 6*a* and an inner pipe 5*b*, 6*b*. A passage sectional area of the inner pipe 5*b*, 6*b* is set to be equal to or lager than a passage sectional area between the outer pipe 5*a*, 6*a* and the inner pipe 5*b*, 6*b*. Thus, a large amount of refrigerant flows through the inner pipe 5*b*, 6*b* to which outside conditions outside the pipes 5, 6 are hardly affected. When the passage sectional area of the inner pipe 5*b*, 6*b* is "A"; the passage sectional area between the outer pipe 5*a*, 6*a* and the inner pipe 5*b*, 6*b* is "B"; the inner radius of the inner pipe 5*b*, 6*b* is "r1"; the thickness of the inner pipe 5*b*, 6*b* is "d"; and the outer radius of the outer pipe 5*a*, 6*a* is "r2", the flowing formulas (1) and (2) are obtained.

$$A=\pi r1^2 \tag{1}$$

$$B=\pi r2^2-\pi(r1+d)^2 \tag{2}$$

In the eighth embodiment, because the passage sectional area of the inner pipe 5*b*, 6*b* is set to be equal to or larger than the passage sectional area between the outer pipe 5*a*, 6*a* and the inner pipe 5*b*, 6*b*, the flowing formulas (3) and (4) can be obtained.

$$\pi r2^2-\pi(r1+d)^2 \leqq \pi r1^2 \tag{3}$$

$$r2 \leqq \sqrt{[r1^2+(r1+d)^2]} \tag{4}$$

That is, in the eighth embodiment, the outer pipe 5*a*, 6*a* and the inner pipe 5*b*, 6*b* are set to have the relationship of formula (4).

According to the eighth embodiment of the present invention, because each of the gas-refrigerant introduction pipe 5 and the liquid-refrigerant introduction pipe 6 is formed in the concentric double-pipe structure having the inner pipe 5*b*, 6*b* and the outer pipe 5*a*, 6*a* as shown in FIG. 16, heat outside the outer pipe 5*a*, 6*a* is hardly transmitted to refrigerant flowing through the inner pipe 5*b*, 6*b*. That is, the circular passage between the outer pipe 5*a*, 6*a* and the inner pipe 5*b*, 6*b*, and refrigerant flowing through the circular passage can be used as a heat-insulating layer. Thus, refrigerant flowing between the outer pipe 5*a*, 6*a* and the inner pipe 5*b*, 6*b* is readily affected by the outer environment, however, refrigerant flowing within the inner pipe 5*b*, 6*b* is hardly affected by the outer environment. As a result, even when air from the exterior fan 8 is blown toward the gas-refrigerant introduction pipe 5 disposed outside the housing 2, it can prevent gas refrigerant flowing within the inner pipe 5*b* from being condensed as shown in FIG. 17. Further, even when air from the interior fan 7 is blown toward the liquid-refrigerant introduction pipe 6 disposed inside the housing 2, it can prevent condensed liquid refrigerant flowing within the inner pipe 6*b* from being boiled as shown in FIG. 18.

Thus, in the eighth embodiment, the phase of refrigerant flowing through the inner passage of the inner pipe 5*b*, 6*b*, is hardly changed with a high-temperature fluid or a low-temperature fluid outside the outer pipe 5*a*, 6*a*, convection flow (opposing flow) of refrigerant can be prevented, and refrigerant is readily circulated. Further, because each of the gas-refrigerant introduction pipe 5 and the liquid-refrigerant introduction pipe 6 has the double-pipe structure, both the pipes 5, 6 can be readily disposed in any position. That is, the gas-refrigerant introduction pipe 5 can be disposed at a position to which air from the exterior fan 8 can be blown, and the liquid-refrigerant introduction pipe 6 can be disposed at a position to which air from the interior fan 7 in the housing 2 can be blown. Accordingly, the connection pipe for connecting the boiling unit 3 and the condensing unit 4 can be readily arranged.

A ninth preferred embodiment of the present invention will be now described with reference to FIG. 19.

Figure 19:
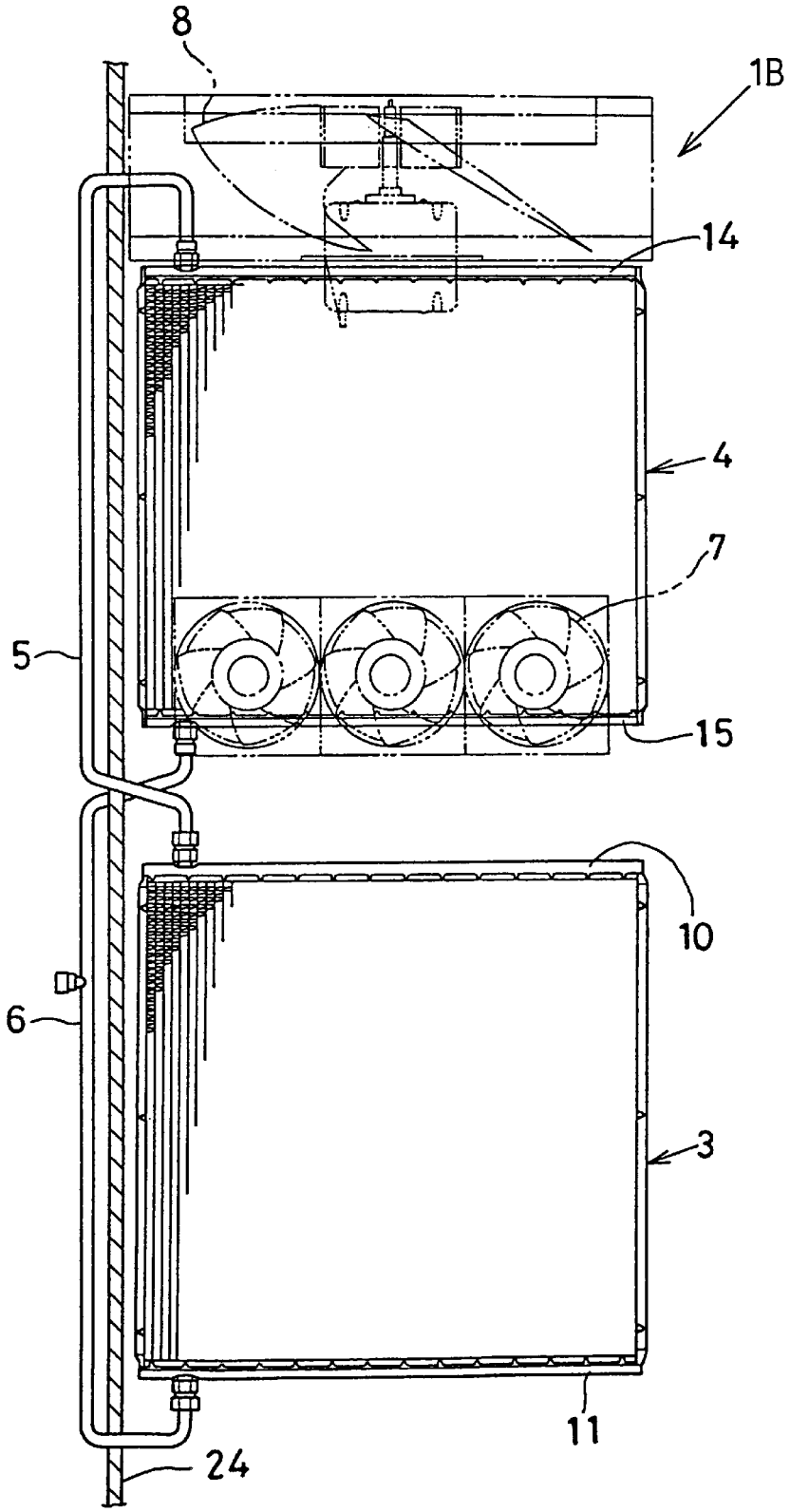
FIG. 19 is a front view showing a cooling device according to a ninth preferred embodiment of the present invention.

In the ninth embodiment, as shown in FIG. 19, the connection port for connecting the gas-refrigerant introduction pipe 5 is formed on the upper tank 10 of the boiling unit 3 at a left end side, and the connection port for connecting the liquid-refrigerant introduction port 6 is formed on the lower tank 15 of the condensing unit 4 at a left end side. That is, a large part of the gas-refrigerant introduction pipe 5 and a large part of the liquid-refrigerant introduction pipe 6 are arranged at the sam sides of the boiling unit 3 and the condensing unit 4, and are partitioned respectively from outside air (i.e., air outside the housing 2) having and from inside air (i.e., air inside the housing 2) by a partition plate 24, as shown in FIG. 19.

According to the ninth embodiment, each of the gas-refrigerant introduction pipe 5 and the liquid-refrigerant introduction pipe 6 has the double-pipe structure. Further, a large part of the gas-refrigerant introduction pipe 5 and a large part of the liquid-refrigerant introduction pipe 6 are partitioned respectively from outside air and inside air by the partition plate 24. Therefore, heat from outside air and inside air is hardly transmitted to refrigerant flowing through the gas-refrigerant introduction pipe 5 and the liquid-refrigerant introduction pipe 6, and refrigerant-circulating performance in a cooling device 1B can be improved. Further, because both the gas-refrigerant introduction pipe 5 and the liquid-refrigerant introduction pipe 6 are arranged at the same sides of the boiling unit 3 and the condensing unit 4, an arrangement space of the gas-refrigerant introduction pipe 5 and the liquid-refrigerant introduction pipe 6 can be made smaller, and the size of the cooling device 1B including the boiling unit 3 and the condensing unit 4 can be reduced.

In the above-described eighth and ninth embodiments, each of the gas-refrigerant introduction pipe 5 and the liquid-refrigerant introduction pipe 6 has the double-pipe structure. However, a multi-pipe structure (e.g., three-layer pipe, four-layer pipe) may be used. In the multi-pipe structure, refrigerant may be not supplied into the sealed most outside passage. Further, only any one of the gas-refrigerant introduction pipe 5 and the liquid-refrigerant introduction pipe 6 may be formed in the multi-pipe structure.

A tenth preferred embodiment of the present invention will be now described with reference to FIGS. 20–22.

In the above-described first embodiment, the gas-refrigerant introduction pipe 5 includes a lateral pipe portion disposed between the boiling unit 3 and the condensing unit 4, and a vertical pipe portion extending in the up-down direction. Therefore, an entire pipe length of the gas-refrigerant introduction pipe 5 is made longer (at least 1.5 times) as compared with a case where the upper tank 10 of the boiling unit 3 and the upper tank 14 of the condensing unit 4 are connected by the shortest distance. Similarly, the liquid-refrigerant introduction pipe 6 includes a lateral pipe portion disposed between the boiling unit 3 and the condensing unit 4, and a vertical pipe portion extending in the up-down direction. Therefore, an entire pipe length of the liquid-refrigerant introduction pipe 6 is made longer (at least 1.5 times) as compared with a case where the lower tank 11 of the boiling unit 3 and the lower tank 15 of the condensing unit 4 are connected by the shortest distance. Thus, a predetermined amount refrigerant can be stored in the gas-refrigerant introduction pipe 5 and the liquid-refrigerant introduction pipe 6, and heat-radiating performance of the cooling device 1 can be maintained in a long time by the reserve refrigerant even if refrigerant leakage is caused. Further, because the lateral pipe portions of the gas-refrigerant introduction pipe 5 and the liquid-refrigerant introduction pipe 6 are disposed between upper tank 10 of the boiling unit 3 and the lower tank 15 of the condensing unit 4, the size of the cooling device 1 is not increased.

Figure 20:
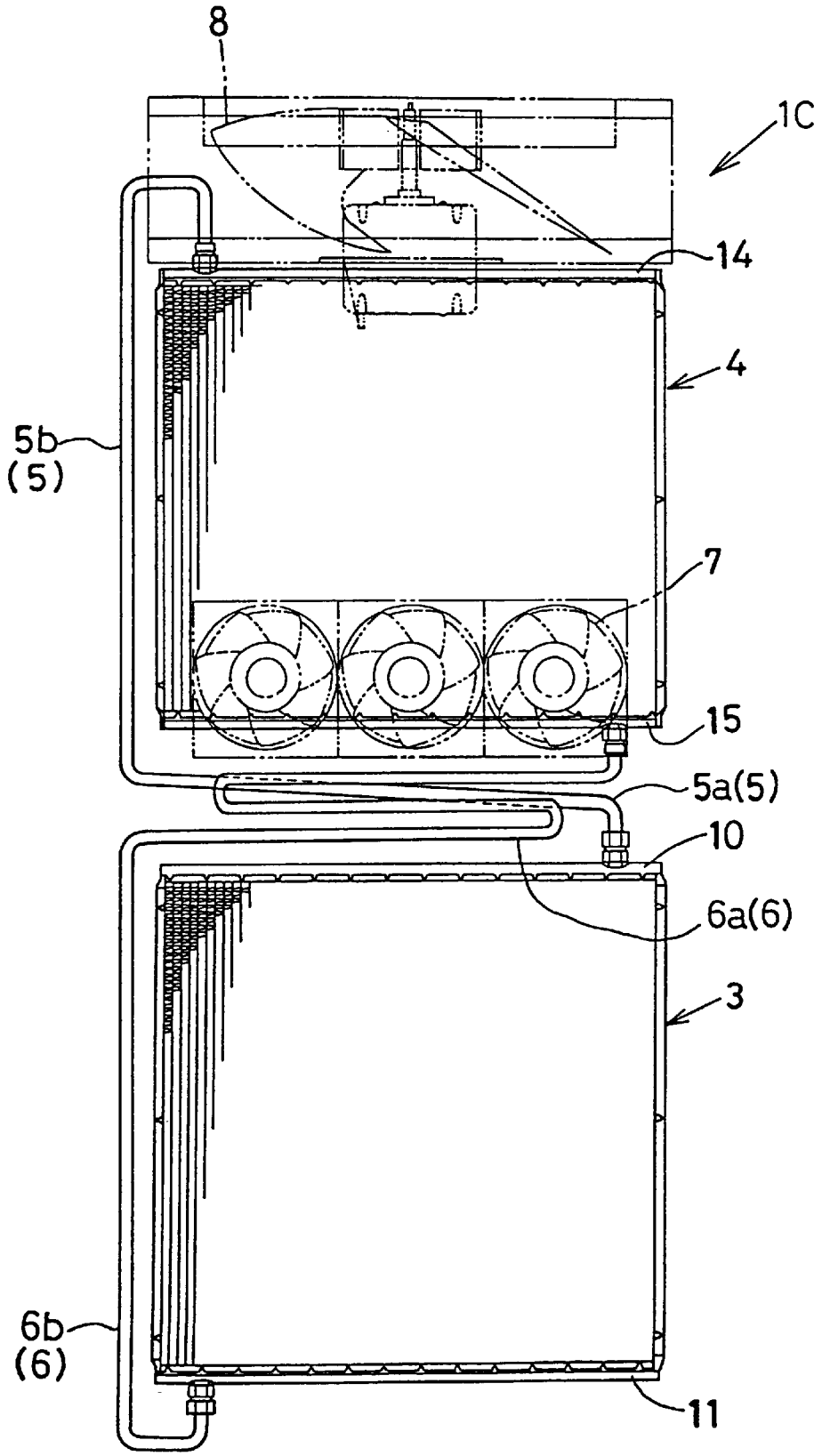
FIG. 20 is a front view showing a cooling device according to a tenth preferred embodiment of the present invention.

In the tenth embodiment, as shown in FIG. 20, similarly to the first embodiment, a liquid-refrigerant introduction pipe 6 includes a lateral pipe portion 6*a* and a vertical pipe portion 6*b*, and a gas-refrigerant introduction pipe 5 includes a lateral pipe portion 5*a* and a vertical pipe portion 5*b*. In the tenth embodiment, the lateral pipe portion 6*a* of the liquid-refrigerant introduction pipe 6 is folded between the upper tank 10 of the boiling unit 3 and the lower tank 15 of the condensing unit 4 to have horizontally extending pipe portions in the right-left direction of a cooling unit 1C. Therefore, it is compared with the first embodiment, the reserve refrigerant amount in the liquid-refrigerant introduction pipe 6 can be made larger, and the radiating performance can be maintained in a longer time. In FIG. 20, the lateral pipe portion 6*a* of the liquid-refrigerant introduction pipe 6 is folded between the upper tank 10 of the boiling unit 3 and the lower tank 15 of the condensing unit 4. However, similarly to the lateral pipe portion 6*a*, the lateral pipe portion 5*a* of the gas-refrigerant introduction pipe 5 may be also folded between the upper tank 10 of the boiling unit 3 and the lower tank 15 of the condensing unit 4.

Figure 21:
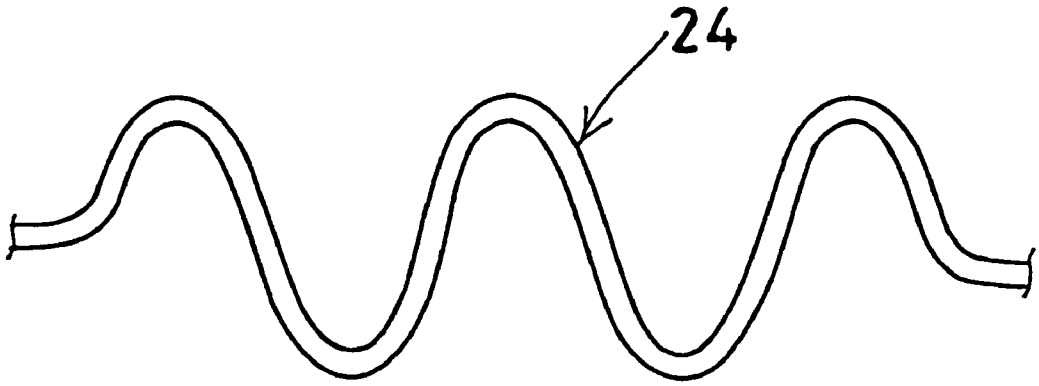
FIG. 21 is a front view showing a curved pipe portion of a connection pipe according to the tenth embodiment.
Figure 22:
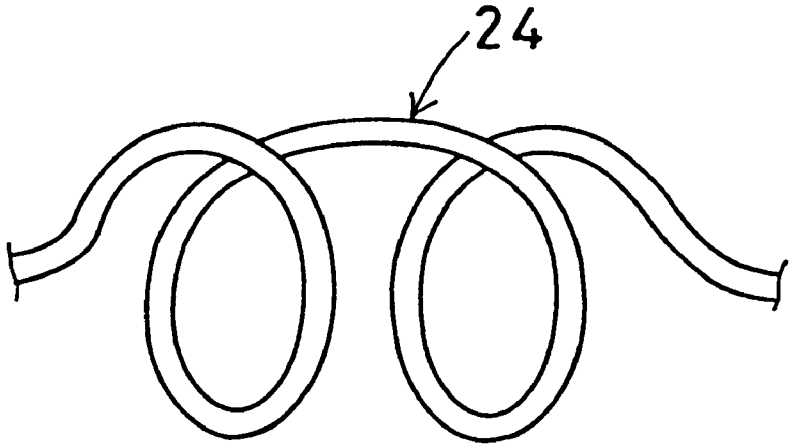
FIG. 22 is a front view showing a curved pipe portion of a connection pipe according to the tenth embodiment.

As shown in FIGS. 21, 22, each of the lateral pipe portions 5*a*, 6*a* may have a curved pipe portion 24. Further, the curved pipe portion 24 may be formed in the vertical pipe portion 5*b* of the gas-refrigerant introduction pipe 5 and the vertical pipe portion 6*b* of the liquid-refrigerant introduction pipe 6. Generally, because pressure loss in the gas-refrigerant introduction pipe 5 is larger than that the liquid-refrigerant introduction pipe 6, the curved pipe portion 24 for storing the reserve refrigerant is provided in the liquid-refrigerant introduction pipe 6 so that a total pressure loss in the cooling device is reduced.

In each of the above-described embodiments, the gas-refrigerant introduction pipe 5 and the liquid-refrigerant introduction pipe 6 are detachably connected to the boiling unit 3 and the condensing unit 4 through the joint members 19–22. However, those parts may be integrally brazed.

An eleventh preferred embodiment of the present invention will be now described with reference to FIGS. 23–25. A cooling unit 100 includes a boiling unit 102 disposed at a high-temperature side, a condensing unit 103 disposed at a low-temperature side, and short and straight both connection pipes 104, 105. The boiling unit 102 includes a plurality of heat receiving tubes 102*a*, upper and lower tanks 102*b*, 102*c* connected to both ends of each heat receiving tube 102*a*, and a plurality of heat receiving fins 102*d*each of which is connected between adjacent the heat receiving tubes 102*a*. A separator 106 is disposed in the upper tank 102*b* of the boiling unit 102 so that an inner space of the upper tank 102*b* is partitioned into left and right two spaces. High-temperature air in a housing forcibly passes through the boiling unit 102 so that liquid refrigerant is boiled and evaporated in the boiling unit 102. The condensing unit 103 includes a plurality of heat radiating tubes 103*a*, upper and lower tanks 103*b*, 103*c* connected to both ends of each heat radiating tube 103*a*, and a plurality of heat radiating fins 103*d* each of which is connected between adjacent the heat radiating tubes 103*a*. A separator 107 is disposed in the lower tank 103*c* of the condensing unit 103 so that an inner space of the lower tank 103*c* is partitioned into left and right two spaces. Low temperature outside air forcibly passes through the condensing unit 103 so that gas refrigerant is condensed and liquefied in the condensing unit 103.

Figure 23:
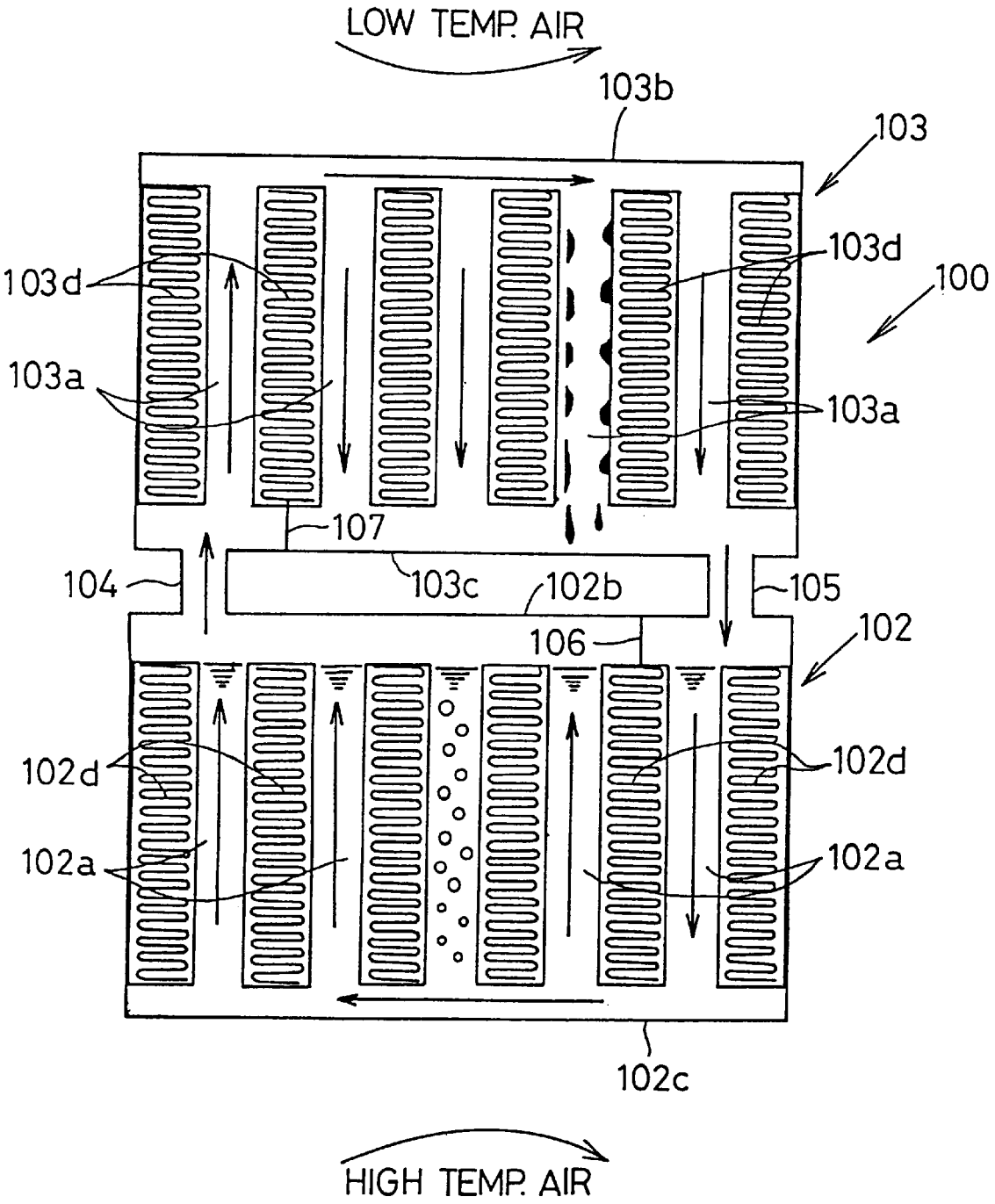
FIG. 23 is a schematic diagram showing a cooling device according to an eleventh preferred embodiment of the present invention.
Figure 24A:
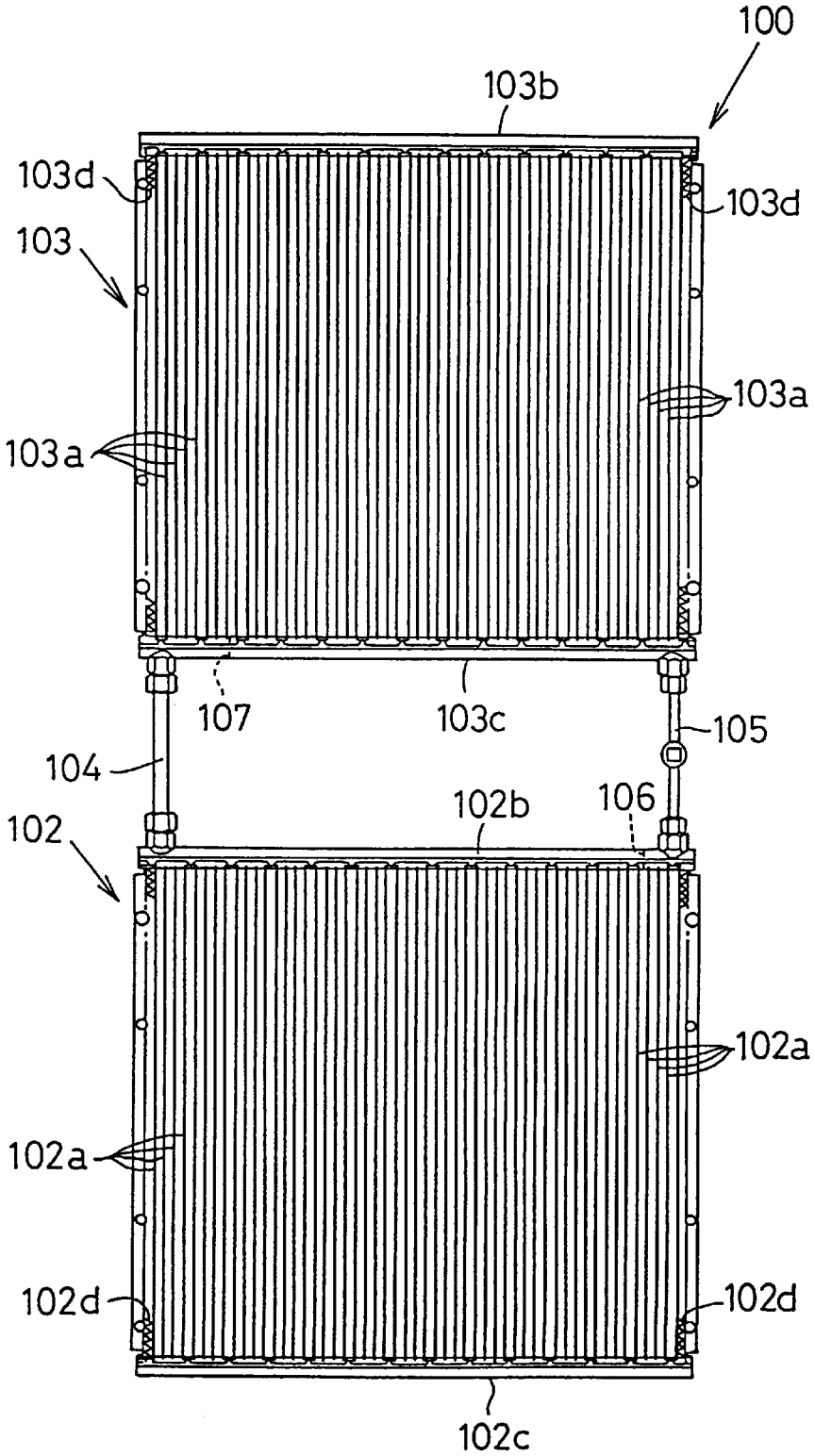
FIGS. 24A, 24B are a front view and a side view, respectively, showing the cooling device according to the eleventh embodiment.
Figure 24B:
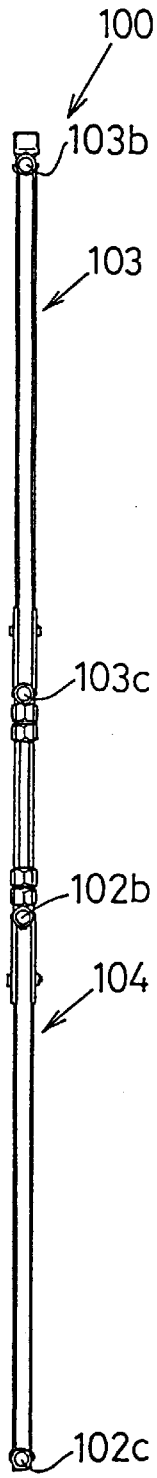
Figure 25:
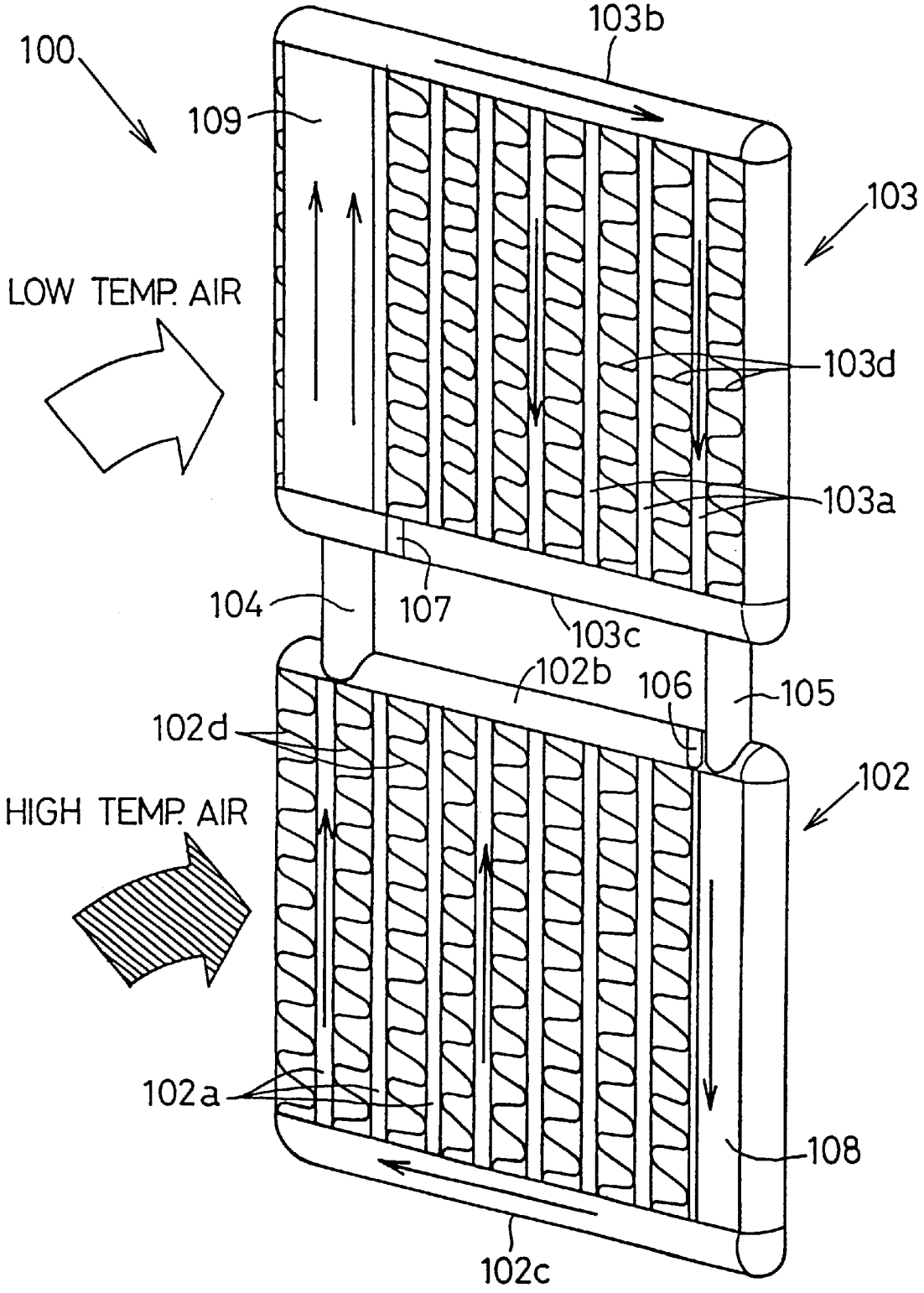
FIG. 25 is a schematic perspective view showing the cooling device according to the eleventh embodiment.

As shown in FIGS. 23–25, the separator 106 is disposed in the upper tank 102*b* of the boiling unit 102 at a right end side. Therefore, the right space of the upper tank 106 communicates with a small part (i.e., small number,) of the heat receiving tubes 102*a*, and the left space of the upper tank 106 communicates with a large part (i.e., large number) of the heat receiving tubes 102*a*. In the eleventh embodiment, the small part of the heat receiving tubes 102*a*is used as a refrigerant passage for supplying condensed liquid refrigerant from the condensing unit 103 to the lower tank 102*c* of the boiling unit 102.

As shown in FIG. 25, a cover 108 is attached so that high temperature air does not contact the small part tubes and the heat receiving fins 102*d* at both sides of the small part tubes. Therefore, liquid refrigerant supplying to the lower tank 102*c* is not evaporated while passing through the small part of the heat receiving tubes 102*a*. The cover 108 is made of a heat-insulating material.

As shown in FIGS. 23–25, the separator 107 is disposed in the lower tank 103*c* of the condensing unit 103 at a left end side. Therefore, the left space of the lower tank 103*c* communicates with a small part (i.e., small number) of the heat radiating tubes 103*a*, and the right space of the lower tank 103*c* communicates with a large part (i.e., large number) of the heat radiating tubes 103*a*. In the eleventh embodiment, the small part of the heat radiating tubes 103*a* is used as a refrigerant passage for supplying gas refrigerant from the boiling unit 102 to the upper tank 103*b* of the condensing unit 103.

As shown in FIG. 25, a cover 109 is attached so that low-temperature air dues not contact the small part tubes and the heat radiating fins 103*d* at both sides of the small part tubes. Therefore, gas refrigerant supplying to the upper tank 103*b* is not evaporated while passing through the small part of the heat radiating tubes 103*a*. The cover 109 is made of a heat-insulating material. In the eleventh embodiment, the tube number of the small part of the heat radiating tubes 103*a* is larger than the tube number of the small part of the heat receiving tubes 102*a*.

The connection pipe 104 connects the left space of the upper tank 102*b* of the boiling unit 102 and the left space of the lower tank 103*c* of the condensing unit 103. The left space of the upper tank 102*b* communicates with the large part of the heat receiving tubes 102*a*, and the left space of the lower tank 103*c* communicates with the small part of the heat radiating tubes 103*a*. Because the connection pipe 104 connects an upper end of the upper tank 102*b* of the boiling unit 102 and a lower end of the lower tank 103*c* of the condensing unit 103, the connection pipe 104 can be shortly straightly formed.

The connection pipe 105 connects the right space of the upper tank 102*b* of the boiling unit 102 and the right space of the lower tank 103*c* of the condensing unit 103. The right space of the upper tank 102*b* communicates with the small part of the heat receiving tubes 102*a*, and the right space of the lower tank 103*c* communicates with the large part of the heat radiating tubes 103*a*. Because the connection pipe 105 connects an upper end of the upper tank 102*b* of the boiling unit 102 and a lower end of the lower tank 103*c* of the condensing unit 103, the connection pipe 105 can be shortly straightly formed.

Next, operation of the cooling unit 100 according to the eleventh embodiment will be now described. When high-temperature air in the housing forcedly passes through the boiling unit 102 by the interior fan, refrigerant is boiled and evaporated in the large part of the heat receiving tubes 102*a* and the evaporated gas refrigerant (i.e., refrigerant vapor) rises. The evaporated gas refrigerant is gathered in the left space of the upper tank 102*b*, and is supplied to the left space of the lower tank 103*c* through the connection pipe 104. The evaporated gas refrigerant supplied to the left space of the lower tank 103*c* is introduced into the upper tank 103*b* of the condensing unit 103 through the small part of the heat radiating tube 103*a*, and is distributed into the large part of the heat radiating tubes 103*a*. In the large part of the heat radiating tubes 103*a*, gas refrigerant radiates heat to outside air, and is condensed and liquefied. The condensed liquid refrigerant is gathered in the right space of the lower tank 103*c*, and is supplied to the right space of the upper tank 102*b* through the connection pipe 105. The condensed liquid refrigerant supplied to the upper tank 102*b* is introduced into the lower tank 102*c* of the boiling unit 102 through the small part of the heat receiving tubes 102*a*, and is returned to the large part of the heat receiving tubes 102*a*.

According to the eleventh embodiment, a part of the heat receiving tubes 102*a* and a part of the heat radiating tubes 103*a* are used as a passage for circulating the refrigerant. Therefore, the boiling unit 102 and the condensing unit 103 can be connected by using short and straight connection pipes 104, 105. Thus, the connecting step for connecting the connection pipes 104, 105 to the boiling unit 102 and the condensing unit 103 can be readily performed without bending the connection pipes 104, 105. Further, because the connection pipes 104, 105 are made short, strength of the connection pipes 104, 105 can be improved, and assembling performance of the connection pipes 104, 105 can be improved. As a result, the cooling unit 100 can be produced in low cost.

Figure 26:
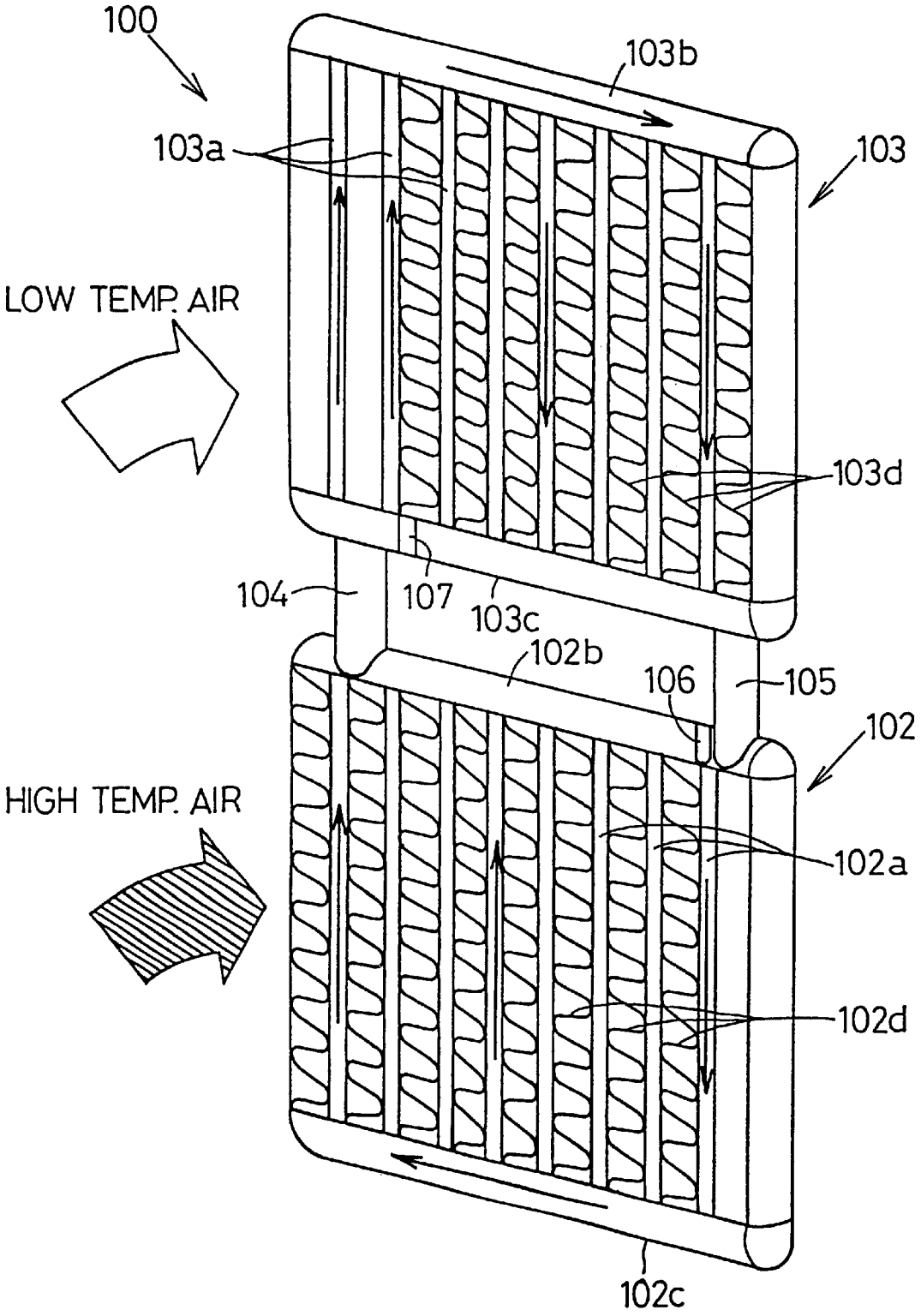
FIG. 26 is a schematic perspective view showing a cooling device according to a twelfth preferred embodiment of the present invention.

A twelfth preferred embodiment of the present invention will be now described with reference to FIG. 26. In the above-described eleventh embodiment, the cover 108 is attached to the small part of the heat receiving tubes 102*a* and both side corrugated fins 102*d* thereof. In the twelfth embodiment, any one corrugated fin 102*d* is not provided within the small part, between the heat receiving tubes 102*a*, and a heat-insulating member is inserted instead of the corrugated fin 102*d*. Thus, heat-insulating effect is further increased in the small part of the heat receiving tube 102*a*.

Similarly, in the above-described eleventh embodiment, the cover 109 is attached to the small part of the heat radiating tubes 103 and both side corrugated fins 103*d* thereof. In the twelfth embodiment, any one corrugated fin 103*d* is not provided within the small part, between the heat radiating tubes 103*a*, and a heat-insulating member is inserted instead of the corrugated fin 103*d*. Thus, heat-insulating effect is further improved in the small part of the heat radiating tube 103*a*.

In the twelfth embodiment, the other portions are similar to those in the eleventh embodiment, and the explanation thereof is omitted.

Figure 27:
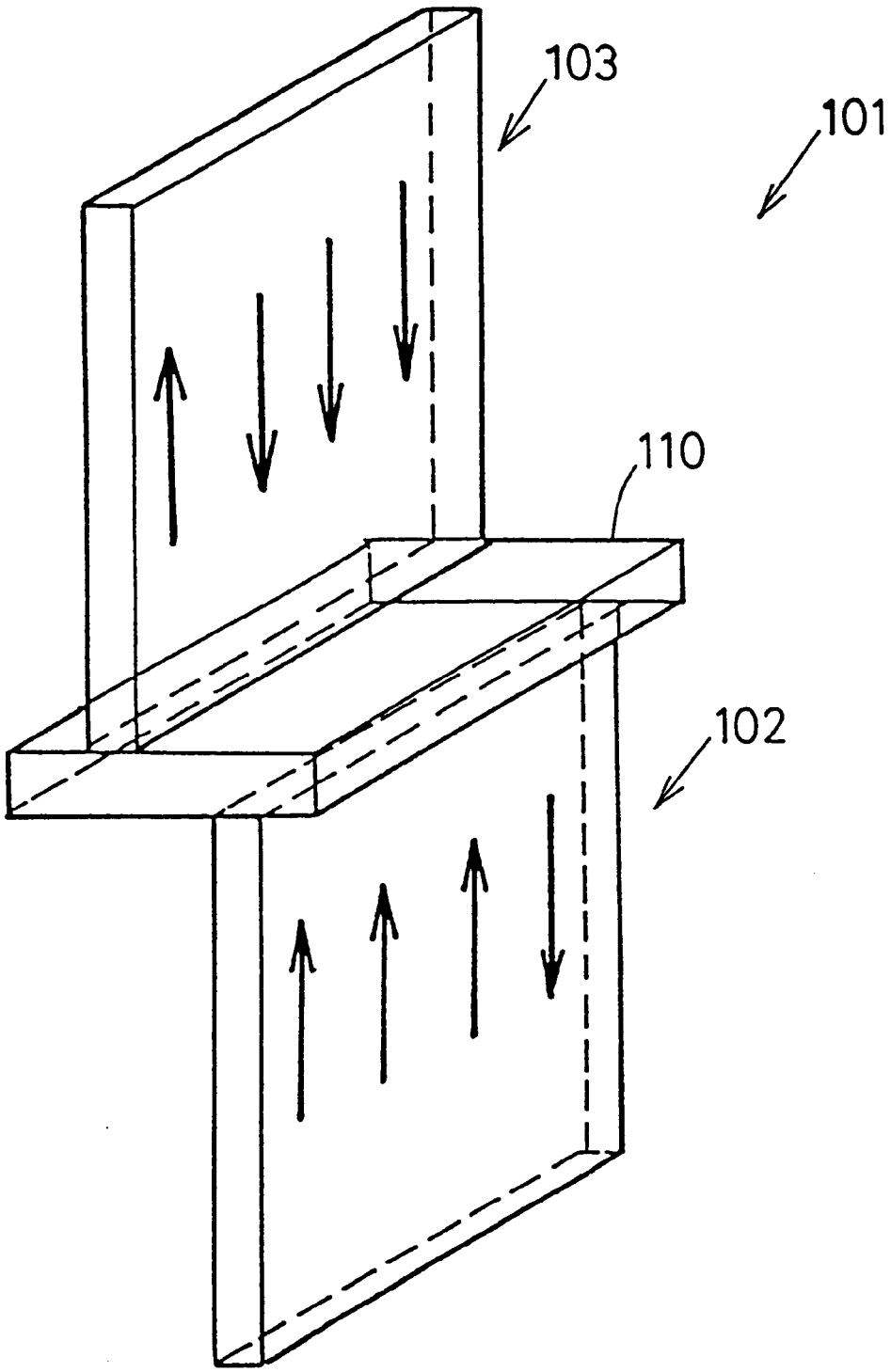
FIG. 27 is a schematic perspective view showing a cooling device according to a thirteenth preferred embodiment of the present invention.

A thirteenth preferred embodiment of the present invention will be now described with reference to FIGS. 27, 28. In each of the above-described eleventh and twelfth embodiments, the connection pipes 104, 105 are formed separately from each other, and are connected to the boiling unit 102 and the condensing unit 103. However, in the thirteenth embodiment, the boiling unit 102 and the condensing unit 103 are formed to have a common tank portion 110 therebetween, and the connection pipes 104, 105 are not provided. As shown in FIG. 27, in a cooling unit 101, the common tank portion 110 is used as both the upper tank of the boiling unit 102 and the lower tank of the condensing unit 103.

Figure 28:
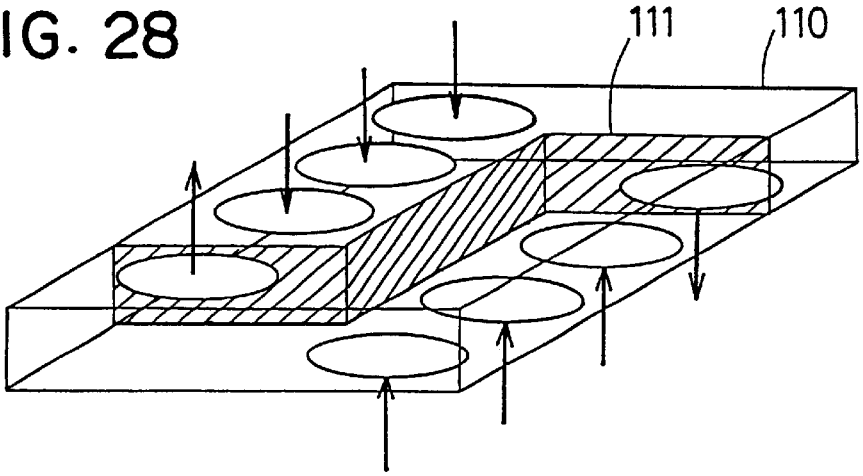
FIG. 28 is a schematic perspective view showing an inner structure of a common tank according to the thirteenth embodiment.

As shown in FIG. 28, a single common separator 111 is disposed within the common tank portion 110, instead of the separators 106, 107 in the eleventh and thirteenth embodiments. By the common separator 111, gas refrigerant rising from the boiling unit 102 to the upper tank 103*b* of the condensing unit 103 is separated from liquid refrigerant lowering from the condensing unit 103 to the lower tank 102*c* of the boiling unit 102. Thus, refrigerant accurately circulates in the cooling unit 101.

A fourteenth preferred embodiment of the present invention will be now described with reference to FIGS. 29, 30. In the above-described thirteenth embodiment, a core portion including the heat receiving tubes 102*a* and fins 103*d* of the boiling unit 102 is disposed to be shifted from a core portion including the heat radiating tubes 103*a* and fins 103*d* of the condensing unit 103 in the air flow direction (front-rear direction). However, in the fourteenth embodiment, a common separator 111 of a cooling device 101A is disposed in a common tank portion 110 as shown in FIG. 29, and the core portion of the boiling unit 102 is not shifted from the core portion of the condensing unit 103 in the air flow direction.

Figure 29:
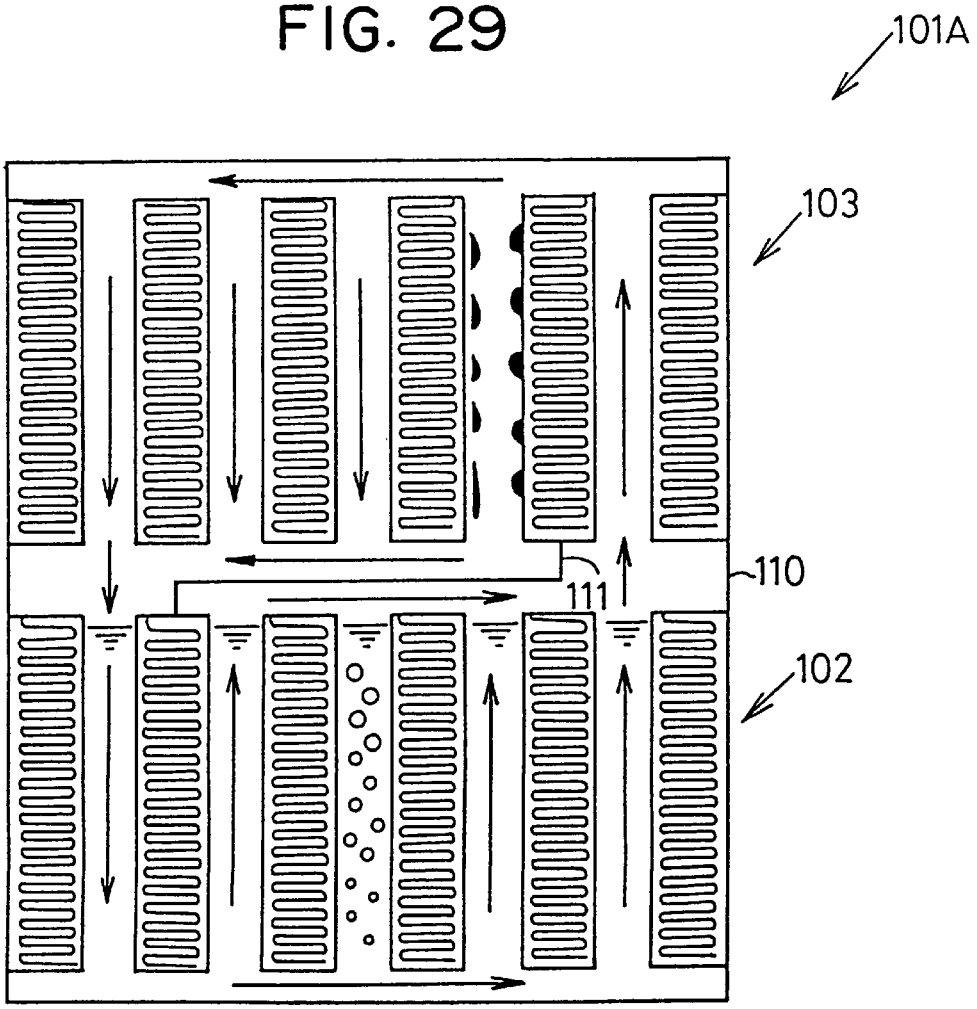
FIG. 29 is a schematic view showing a cooling device according to a fourteenth preferred embodiment of the present invention.
Figure 30:
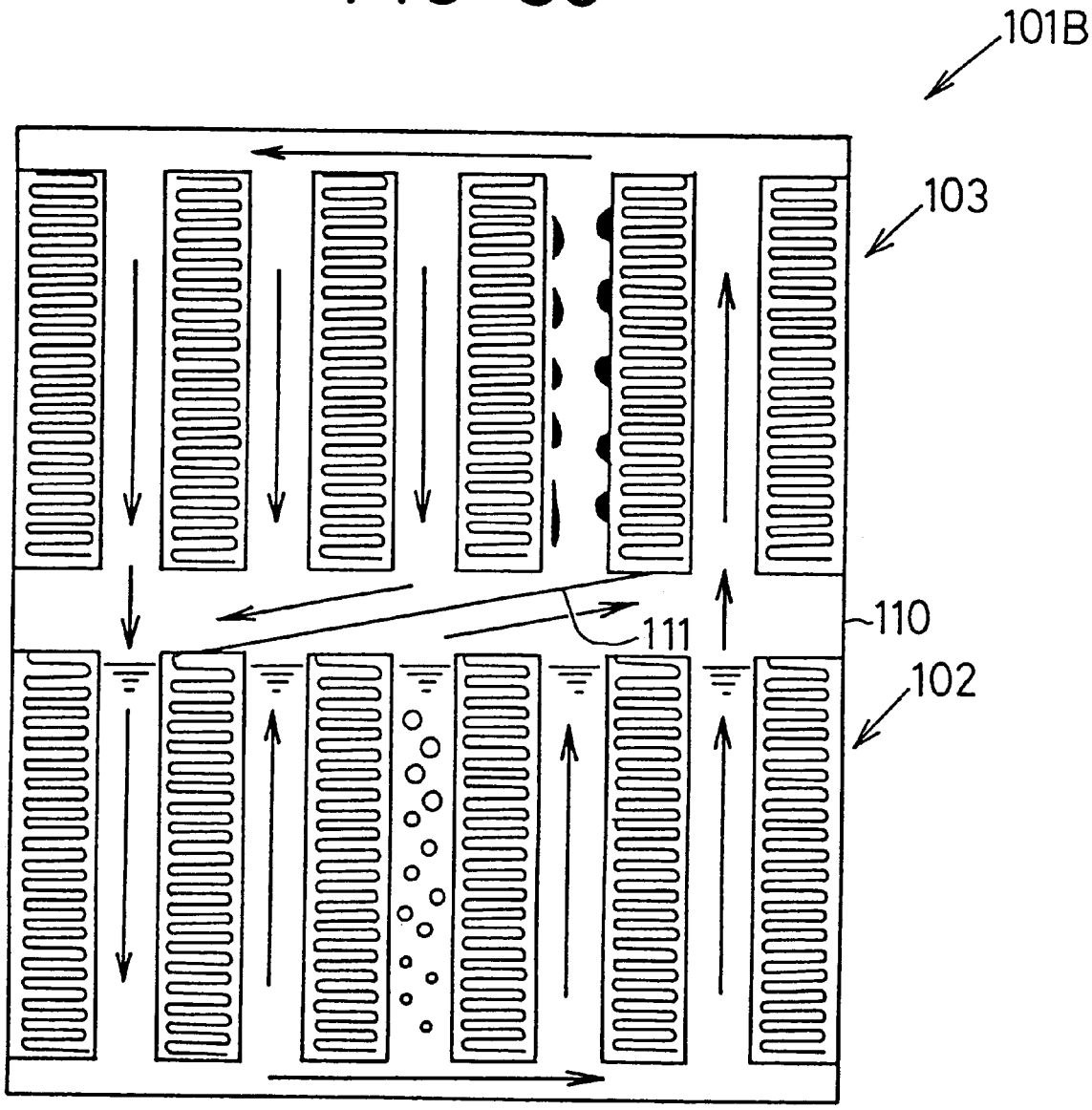
FIG. 30 is a schematic view showing a cooling device according to the fourteenth embodiment.
Figure 31:
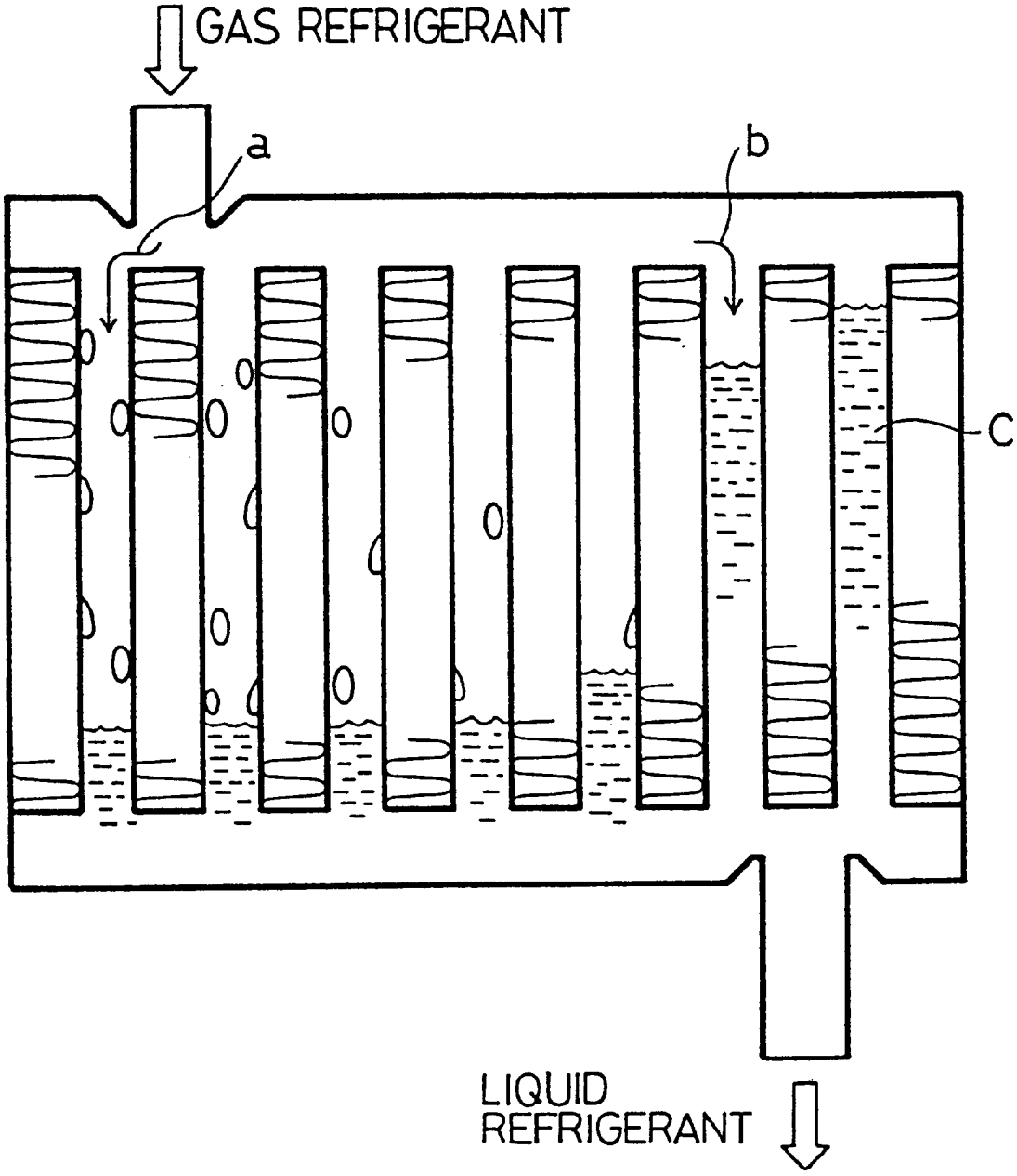
FIG. 31 PRIOR ART
FIG. 31 is a schematic sectional view showing a conventional condensing unit.

In FIG. 29, the separator 11 is formed into a step like in cross section. However, as shown in FIG. 30, a plate-like separator 11 may be disposed obliquely in the common tank portion 110 of a cooling device 101B.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A cooling device for boiling and condensing refrigerant, the cooling device cooling a heat-generating member contained within a housing, comprising:

a first heat exchanger in which refrigerant flows, said first heat exchanger being disposed inside said housing to perform heat exchange between said refrigerant flowing therethrough and high-temperature first fluid within said housing;

a second heat exchanger in which refrigerant flows, said second heat exchanger having upper and lower tanks extending in a tank longitudinal direction and a plurality of tubes through which said upper and lower tanks communicate with each other, said second heat exchanger being disposed outside said housing to perform heat exchange between said refrigerant flowing therethrough and low-temperature second fluid outside said housing;

a first connection pipe through which gas refrigerant boiled in said first heat exchanger is introduced into said upper tank of said second heat exchanger; and a second connection pipe through which liquid refrigerant condensed in said second heat exchanger is returned to said first heat exchanger from said lower tank of said second heat exchanger, wherein:

said first connection pipe has a plurality of first branched pipes connected to said upper tank of said second heat exchanger in a T-shape; and said second connection pipe is connected to said lower tank of said second heat exchanger in such a manner that position relationships of said first branched pipes relative to said second connection pipe are left-right unsymmetrical.

2. The cooling device according to claim 1, wherein said second connection pipe is connected to said lower tank at a position approximately equal to one of said first branched pipes in said tank longitudinal direction.

3. The cooling device according to claim 1, wherein:

said second connection pipe has a plurality of second branched pipes connected to said lower tank of said second heat exchanger; and said second branched pipes of said second connection pipe have a number smaller than that of said first branched pipes of said first connection pipe.

4. The cooling device according to claim 1, wherein:

said second connection pipe has a plurality of second branched pipes connected to said lower tank of said second heat exchanger; and the position relationships of said first branched pipes relative to said second branched pipes are left-right unsymmetrical.

5. The cooling device according to claim 4, wherein:

said first branched pipes are classified into a first group in which said first branched pipes are arranged at the positions approximately equal to the positions of said second branched pipes in said longitudinal direction, and a second group excepting from said first group; and said second group is arranged so that all said first branched pipes are approximately uniformly disposed in said tank longitudinal direction.

6. The cooling device according to claim 1, wherein at least one of said first connection pipe and said second connection pipe is formed into a multi-pipe structure in which a plurality of pipes having different diameters are assembled approximately concentrically.

7. The cooling device according to claim 1, wherein:

said second connection pipe has a predetermined pipe length so that a predetermined reserve refrigerant is stored; and said second connection pipe has a lateral pipe portion extending approximately horizontally, said lateral pipe portion being disposed between said first heat exchanger and said second heat exchanger.

* * * * *